US005926675A

United States Patent [19]

Miyano et al.

[11] Patent Number: 5,926,675

[45] Date of Patent: Jul. 20, 1999

[54] SEAL MEMBER REMOVING TOOL AND SEAL MEMBER REMOVING METHOD

[75] Inventors: Kazuyuki Miyano, Mishima; Hiroumi Morinaga, Susono, both of Japan

[73] Assignee: Canon Kabushiki Kaisha, Tokyo, Japan

[21] Appl. No.: 09/075,217

[22] Filed: May 11, 1998

[30] Foreign Application Priority Data

May 14, 1997 [JP] Japan ..... 9-124427
Apr. 22, 1998 [JP] Japan ..... 10-112511

[51] Int. Cl.[6] ..... G03G 15/08

[52] U.S. Cl. ..... 399/262; 399/103; 399/109

[58] Field of Search ..... 399/102, 103, 399/106, 109, 119, 262; 81/3.07; 215/295, 302

[56] References Cited

U.S. PATENT DOCUMENTS 5,185,616 2/1993 Wilcke ..... 399/262 X
5,557,382 9/1996 Tatsumi et al. ..... 399/262
5,579,101 11/1996 Omata et al. .
5,598,254 1/1997 Ikesue et al. ..... 399/262
5,765,079 6/1998 Yoshiki et al. ..... 399/262 X

*Primary Examiner*—Sandra Brase
*Attorney, Agent, or Firm*—Fitzpatrick, Cella, Harper & Scinto

[57] ABSTRACT

The present invention provides a seal member removing tool for removing a seal member fitted in a developing agent loading opening of a developing agent container, comprising a bent body portion, and an abutment portion provided on one end of the body portion and adapted to abut against the seal member from inside of the container to remove the seal member from the container. The present invention further provides seal member removing method effected by using such a seal member removing tool.

10 Claims, 27 Drawing Sheets

SEAL MEMBER REMOVING TOOL AND SEAL MEMBER REMOVING METHOD

BACKGROUND OF THE INVENTION

1. Field of the Invention

The present invention relates to a seal member removing tool and a seal member removing method, which can remove a seal member closing a developing agent loading opening of a developing agent container from the developing agent container.

2. Related Background Art

In some conventional electrophotographic image forming apparatuses, a process cartridge is detachably mounted on a body of the electrophotographic image forming apparatus (referred to as "main body" hereinafter). The electrophotographic image forming apparatus serves to form an image on a recording medium by utilizing an electrophotographic image forming process and may include, for example, an electrophotographic copying machine, an electrophotographic printer (laser beam printer or LED printer), an electrophotographic facsimile, an electrophotographic word processor and the like.

In the electrophotographic image forming apparatus utilizing the electrophotographic image forming process, a photosensitive drum (electrophotographic photosensitive member) uniformly charged by a charge means is selectively exposed in response to image information to form a latent image on the photosensitive drum. Thereafter, the latent image is developed by a developing means with toner to form a toner image. Then, the toner image formed on the photosensitive drum is transferred onto a recording medium by a transfer means. In this way, image formation is effected.

On the other hand, the process cartridge which can detachably be mounted to the main body integrally incorporates the charge means, the developing means, a cleaning means and the photosensitive drum as a cartridge unit which can detachably be mounted to the main body. Incidentally, the process cartridge may incorporate the photosensitive drum and at least one of the charge means, developing means and cleaning means as a cartridge unit which can detachably be mounted to the main body, or may incorporate the photosensitive drum and at least the developing means as a cartridge unit which can detachably be mounted to the main body.

By using such a process cartridge, since the maintenance of the apparatus can be performed by an operator himself without any expert, operability is improved greatly. Thus, such a process cartridge has widely been used in the image forming apparatuses.

The toner is contained in a toner container (developing agent container) of the process cartridge. When the toner is loaded in the toner container, the toner is loaded through a toner loading opening previously formed in the toner container, and then, the toner loading opening is closed or sealed firmly by a seal member to prevent the toner from leaking from the toner loading opening during transportation.

SUMMARY OF THE INVENTION

An object of the present invention is to provide a seal member removing tool and a seal member removing method, in which a seal member closing a developing agent loading opening of a developing agent container can surely be removed from the developing agent container.

Another object of the present invention is to provide a seal member removing tool and a seal member removing method, in which a seal member closing a developing agent loading opening of a developing agent container can surely be removed from the developing agent container, without damaging the developing agent container and the seal member.

The other objects and features of the present invention will be apparent from the following detailed explanation of the invention referring to the accompanying drawings.

DETAILED DESCRIPTION OF THE PREFERRED EMBODIMENTS

Now, embodiments of the present invention will be explained with in connection with embodied modes thereof reference to the accompanying drawings.

First of all, a preferred embodied mode of the present invention will be described. In the explanation hereinbelow, a "width-wise direction" of a process cartridge means a direction (process cartridge mounting/dismounting direction) along which the process cartridge is mounted and dismounted with respect to a main body of an image forming apparatus and which coincides with a recording medium conveying direction. A "longitudinal direction" of the process cartridge means a direction transverse (substantially perpendicular) to the process cartridge mounting/dismounting direction and parallel with a surface of the recording medium and transverse (substantially perpendicular) to the recording medium conveying direction. Further, "left" or "right" regarding the process cartridge are right or left with respect to the recording medium conveying direction, looked at from the above. Further, in the explanation hereinbelow, an "upper surface" of the process cartridge means a surface facing upwardly when the process cartridge is mounted on the main body, and a "lower surface" means a surface facing downwardly when the process cartridge is mounted on the main body.

Electrophotographic Image Forming Apparatus A and Process Cartridge B

First of all, a laser beam printer as an electrophotographic image forming apparatus to which an embodied mode of the present invention is applied will be explained with reference to FIGS. 1 and 2.

Figure 1:
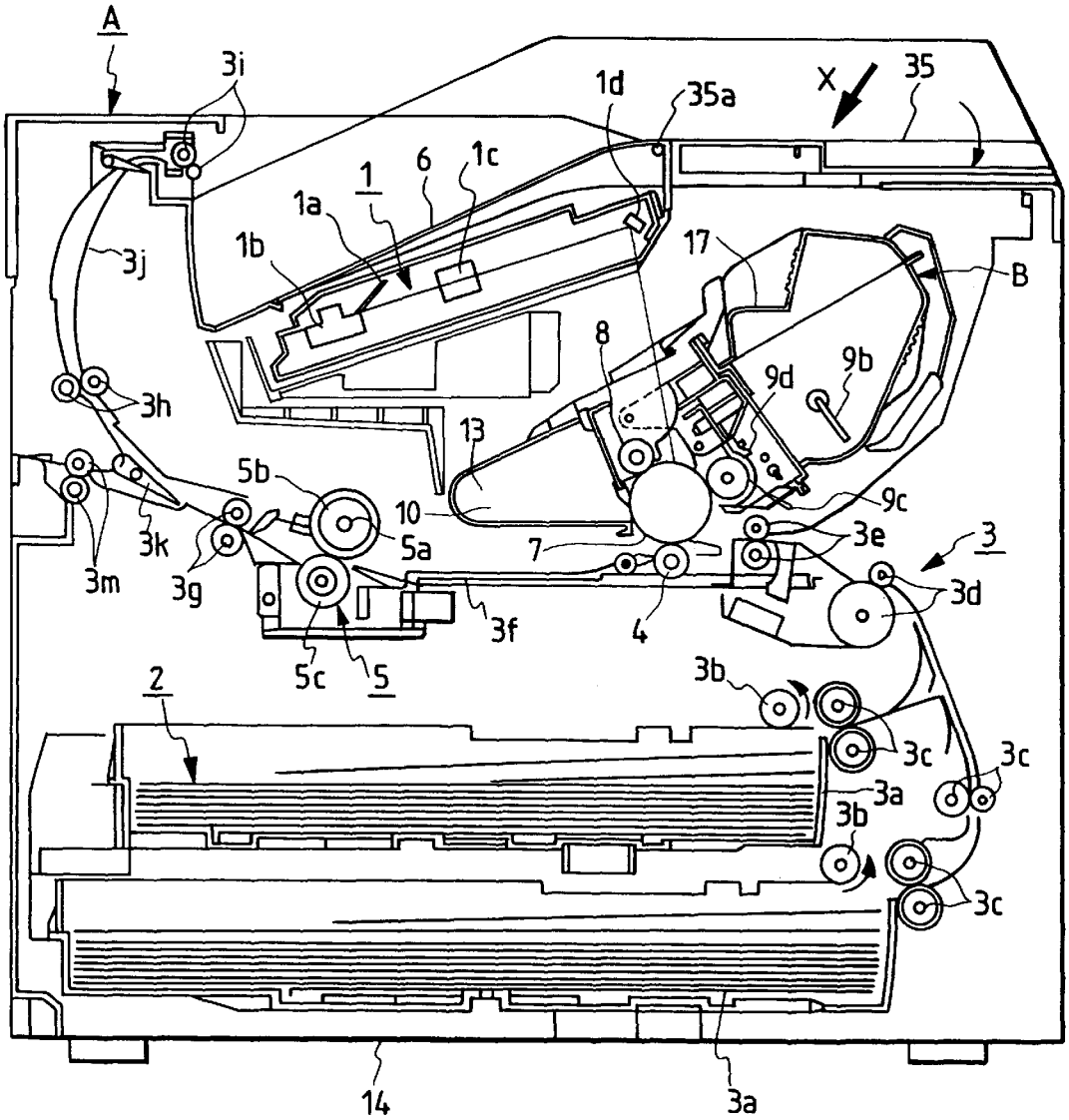
FIG. 1 is an elevational sectional view of an electrophotographic image forming apparatus.

In FIG. 1, the laser beam printer A serves to form an image on a recording medium (for example, a recording sheet, an OHP sheet, a cloth or the like) by utilizing an electrophotographic image forming process. A tone image is formed on a photosensitive drum (electrophotographic photosensitive member). More specifically, the photosensitive drum is charged by a charge means, and then, a latent image corresponding to image information is formed on the photosensitive drum by illuminating a laser beam corresponding to the image information from an optical means onto the photosensitive drum. Thereafter, the latent image is developed by a developing means to form a toner image. In synchronous with formation of the toner image, a recording medium 2 is picked up from a sheet supply cassette 3*a* by means of pick-up roller 3*b* and is conveyed while being reversed by means of pairs of convey rollers 3*c*, 3*d* and a pair of regist rollers 3*e*.

Then, the tone image formed on the photosensitive drum 7 of the process cartridge B is transferred onto the recording medium 2 by applying voltage to a transfer roller (transfer means) 4. Thereafter, the recording medium 2 to which the toner image was transferred is sent to a fixing means 5 through a convey guide 3*f*. The fixing means 5 includes a drive roller 5*c*, and a fixing roller 5*b* having a heater 5*a* therein. While the recording medium 2 is being passed between these rollers, heat and pressure are applied to the recording medium, thereby fixing the toner image to the recording medium. Thereafter, the recording medium 2 is conveyed through a reverse path 3*j* by pairs of discharge rollers 3*g*, 3*h*, 3*i* and then is discharged onto a discharge tray 6 formed on an upper surface of a main body 14 of the image forming apparatus A. Incidentally, a rockable flapper 3*k* may be operated to discharge the recording medium 2 by a pair of discharge rollers 3*m* without passing through the reverse path 3*j*. In the illustrated embodied mode, the pick-up roller 3*c*, pairs of convey rollers 3*c*, 3*d*, pair of regist rollers 3*e*, convey guide 3*f*, pairs of discharge rollers 3*g*, 3*h*, 3*i* and pair of discharge rollers 3*m* constitute a convey means 3.

In the process cartridge B, while the photosensitive drum 7 having a photosensitive layer (not shown) is being rotated, the surface of the photosensitive drum is uniformly charged by applying voltage to a charge roller (charge means) 8. Then, the latent image is formed by illuminating a laser beam corresponding to the image information from an optical system 1 onto the photosensitive drum 7 through an exposure opening portion 1*e*, and the latent image is developed by a developing means 9 with toner. More specifically, the charge roller 8 is contacted with the photosensitive drum and is rotatingly driven by rotation thereof, thereby charging the photosensitive drum 7. The developing means 9 supplies the toner to a developing area of the photosensitive drum 7, thereby developing the latent image formed on the photosensitive drum 7. Incidentally, the optical system 1 includes a laser diode 1*a*, a polygon mirror 1*b*, a lens 1*c*, and a reflection mirror 1*d*.

In the developing means 9, the toner in a toner containing portion (developing agent container) 11A is sent to a developing roller 9*c* having a fixed magnet therein by rotation of a toner feed member 9*b*. While the developing roller 9*c* is being rotated, a toner layer (frictionally charged by a developing blade 9*d*) is formed on the developing roller 9*c*, and the toner layer is supplied to the developing area of the photosensitive drum 7. By transferring the toner onto the latent image on the photosensitive drum 7, the latent image is visualized as a toner image. The developing blade 9*d* serves to regulate an amount of toner on the peripheral surface of the developing roller 9*c* and to frictionally charge the toner. A toner agitating member 9*e* for circulating the toner within a developing chamber is rotatably mounted in the vicinity of the developing roller 9*c*.

After the toner image formed on the photosensitive drum 7 is transferred to the recording medium 2 by applying voltage having polarity opposite to that of the toner image to the transfer roller 4, residual toner removing on the photosensitive drum 7 is removed by a cleaning means 10. That is to say, in the cleaning means 10, the residual toner remaining on the photosensitive drum 7 is scraped by an elastic cleaning blade 10*a* urged against the photosensitive drum 7, and the scraped toner is collected into a waste toner reservoir 10*b*.

The process cartridge B is constituted by joining a toner frame 11 including the toner containing portion 11A to a developing frame 12 holding the developing means 9 such as the developing roller 9*c* and by further joining to it a cleaning frame 13 to which the cleaning means 10 such as the cleaning blade 10*a* and the charge roller 8 are attached. Next, the process cartridge B will be described fully.

Figure 2:
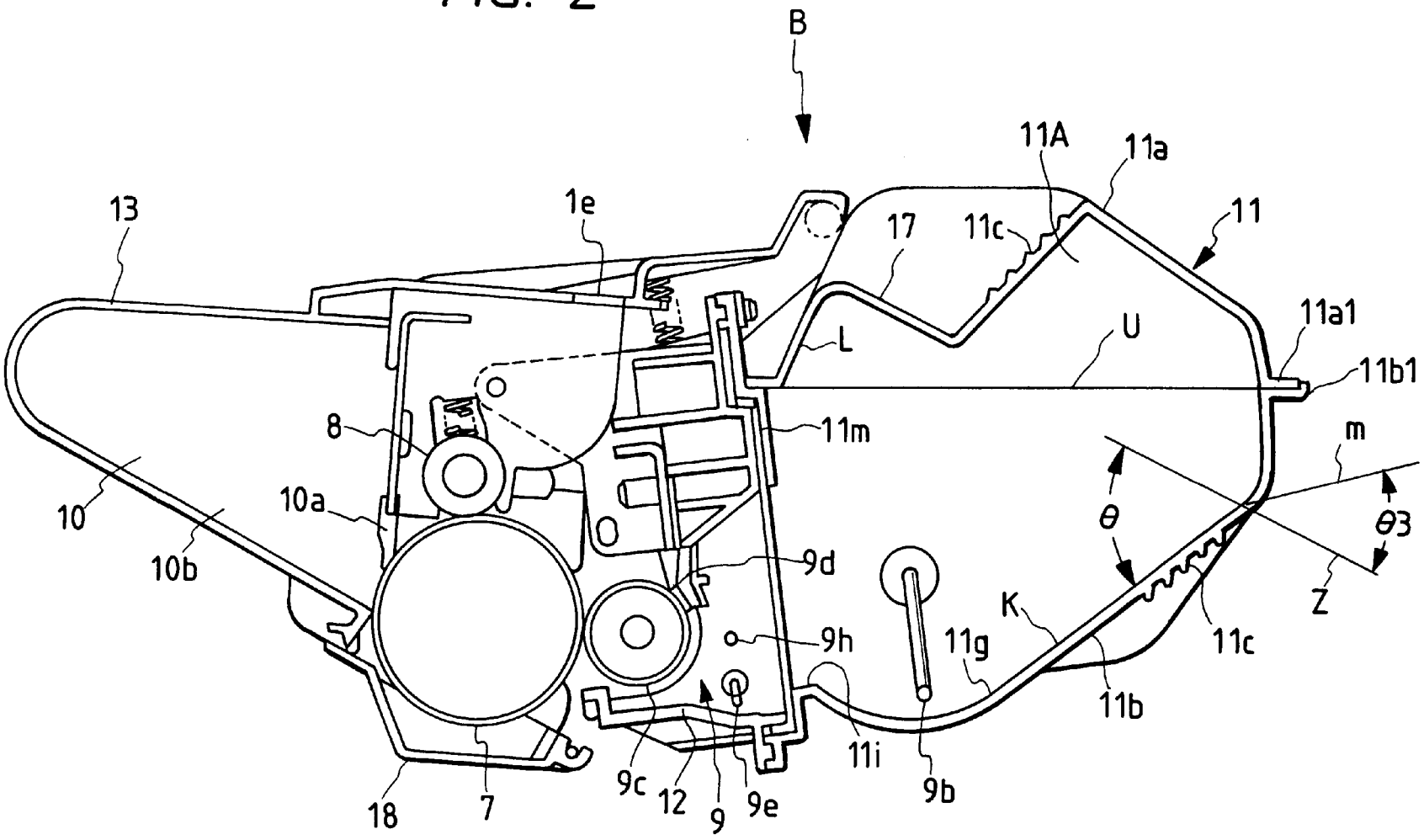
FIG. 2 is a sectional view of a process cartridge which can detachably be mounted on the electrophotographic image forming apparatus.

As shown in FIG. 2, the toner feed member 9*b* is rotatably attached to the toner frame 11. Further, the developing roller 9*c* and the developing blade 9*d* are attached to the developing frame 12 and the toner agitating member 9*e* for circulating the toner within the developing chamber is rotatably mounted in the vicinity of the developing roller 9*c*. In addition, an antenna rod 9*h* is attached to the developing frame 12 substantially in parallel with the developing roller 9*c* along a longitudinal direction of the developing roller 9*c*.

Figure 4:
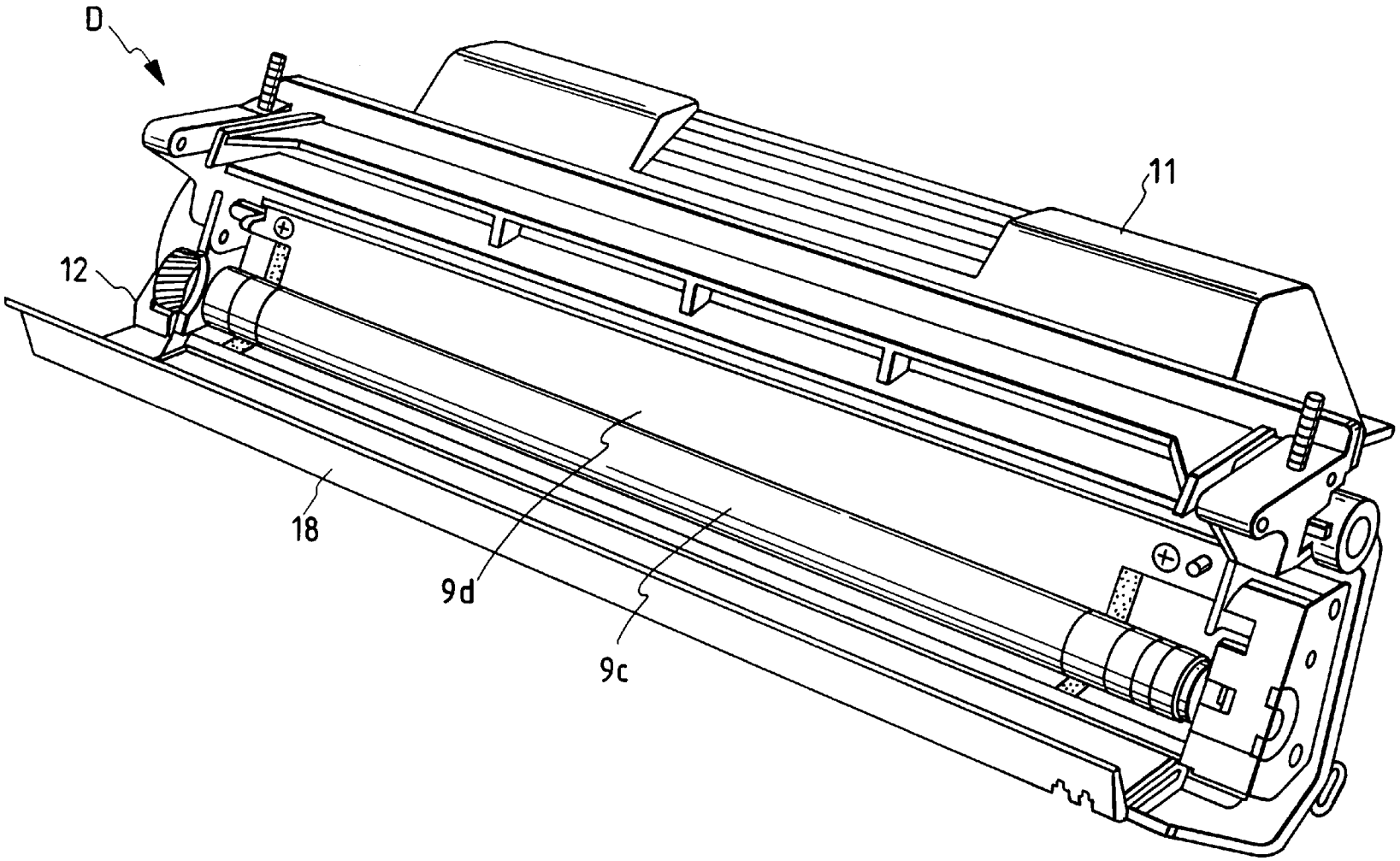
FIG. 4 is a perspective view of a developing unit of the process cartridge.

The toner frame 11 is welded to the developing frame 12 (by ultrasonic welding in this case) to form a developing unit D as shown in FIG. 4. A drum shutter member 18 for covering the photosensitive drum 7 when the process cartridge B is dismounted from the main body 14 to prevent the photosensitive drum from being exposed to the light for a long time and from being contacted with foreign matters is attached to the developing unit D.

Figure 5:
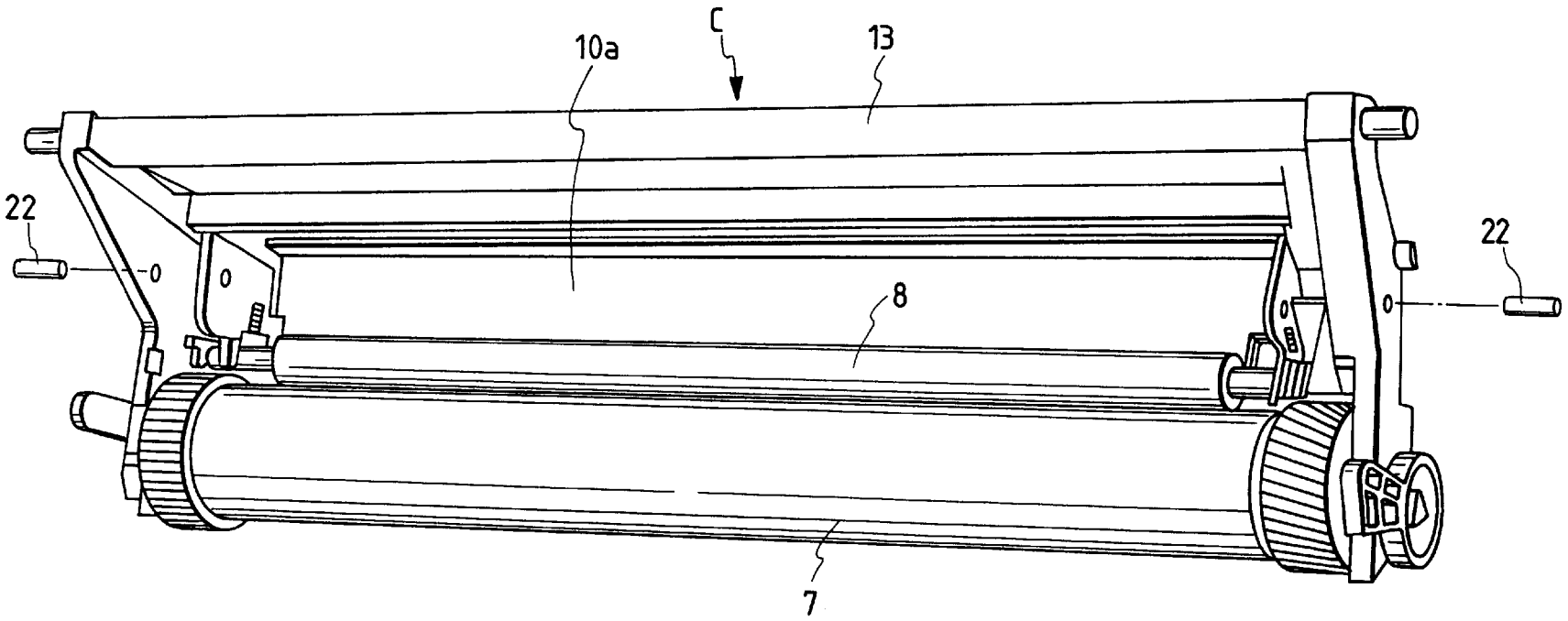
FIG. 5 is a perspective view of a cleaning unit of the process cartridge.

The photosensitive drum 7, charge roller 8 and cleaning means 10 are attached to the cleaning frame to form a cleaning unit C as shown in FIG. 5. In FIG. 5, the developing unit D is joined to the cleaning unit C by connecting members (cylindrical pins) 22 so that the developing unit D and the cleaning unit C are interconnected for relative pivotal movement around the connecting members 22.

Next, the toner frame will be fully described.

As shown in FIG. 2, the toner frame 11 is constituted by two pieces, i.e., an upper frame 11*a* and a lower frame 11*b*. As shown in FIG. 1, the upper frame 11*a* is swollen upwardly to occupy a space at the right of the optical system 1 within the main body 14 of the image forming apparatus, so that the amount of toner within the process cartridge B can be increased without making the image forming apparatus A bulky.

Figure 3:
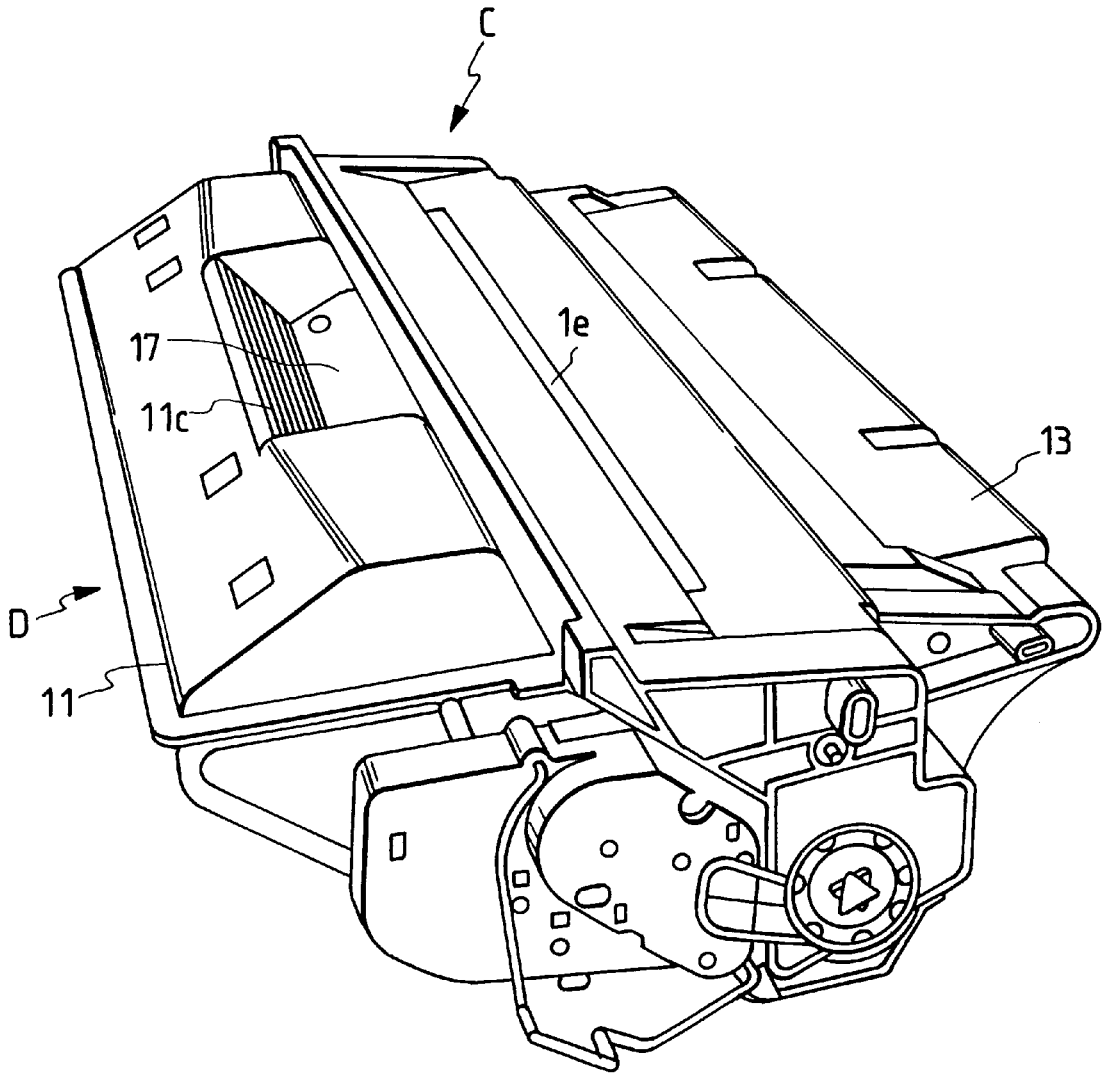
FIG. 3 is a perspective view of the process cartridge.

As shown in FIGS. 2 and 3, a recessed portion 17 is formed on an outer surface of the upper frame 11*a* at a longitudinal central portion thereof, which recessed portion acts as a grip. Thus, the operator can hold the process cartridge by gripping the recessed portion 17 of the upper frame 11*a* and a lower surface of the lower frame 11*b* by his hand. Incidentally, longitudinal ribs 11*c* formed on one side of the recessed portion 17 and the lower surface of the lower frame 11*b* acts as slip preventing elements when the process cartridge B is held by the operator.

As shown in FIG. 2, the frames 11*a*, 11*b* are integrally connected to each other by fitting a flange 11*a*1 of the upper frame 11*a* into a peripheral flange 11*b*1 of the lower frame 11*b* and by welding weld ribs on a welding surface U by ultrasonic welding. The connecting method is not limited to the ultrasonic welding, but, for example, heat welding, forcible vibration or adhesive may be used.

Figure 6:
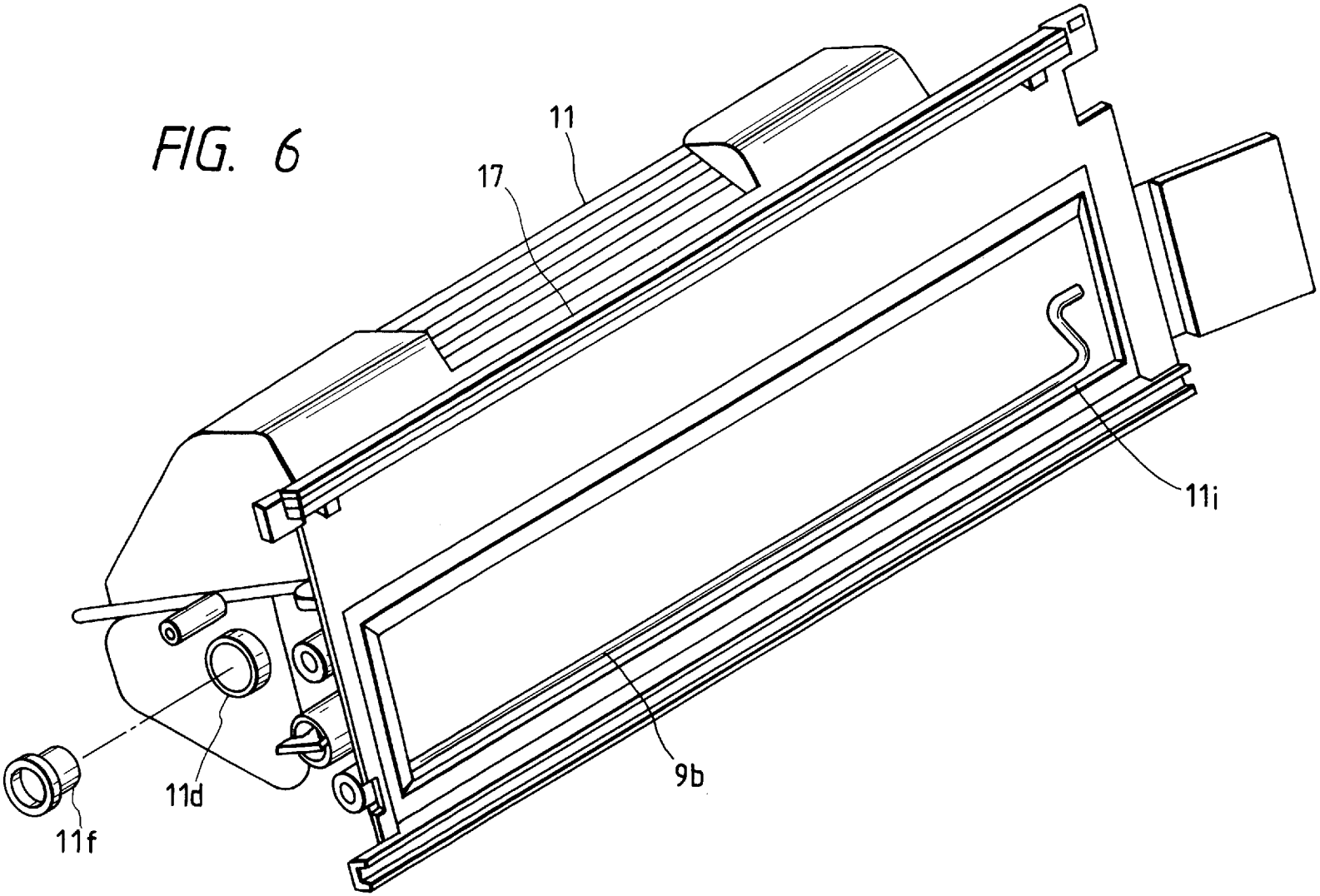
FIG. 6 is a perspective view of a toner frame.

As shown in FIG. 6, a toner loading opening 11*d* through which the toner is loaded is formed in one longitudinal end wall of the lower frame 11*b*, and an opening portion 11*i* through which the toner is sent from the toner frame 11 to the developing frame 12 is formed in the toner frame 11 along the longitudinal direction thereof. After the toner is loaded through the toner loading opening 11*d*, when the toner loading opening 11*d* is closed by a toner cap 11*f*, a toner unit is completed. When the toner unit is connected to the developing frame 12 by ultrasonic welding, the developing unit D is formed. The connecting method is not limited to the ultrasonic welding, but, for example, adhesive or snap-fit utilizing an elastic force may be used.

Regarding the process cartridge B having the above-mentioned construction, when the toner in the toner container is consumed or used up, the old process cartridge is exchanged to a new process cartridge. And, the old cartridge is decomposed for re-use or recycle. In order to decompose the process cartridge B, first of all, the cleaning unit C is disconnected from the developing unit D, and, then, the developing unit D is divided into the developing frame 12 and the toner frame 11, and, finally, the toner cap (referred to merely as "cap" hereinafter) is removed from the toner frame 11.

Figure 7:
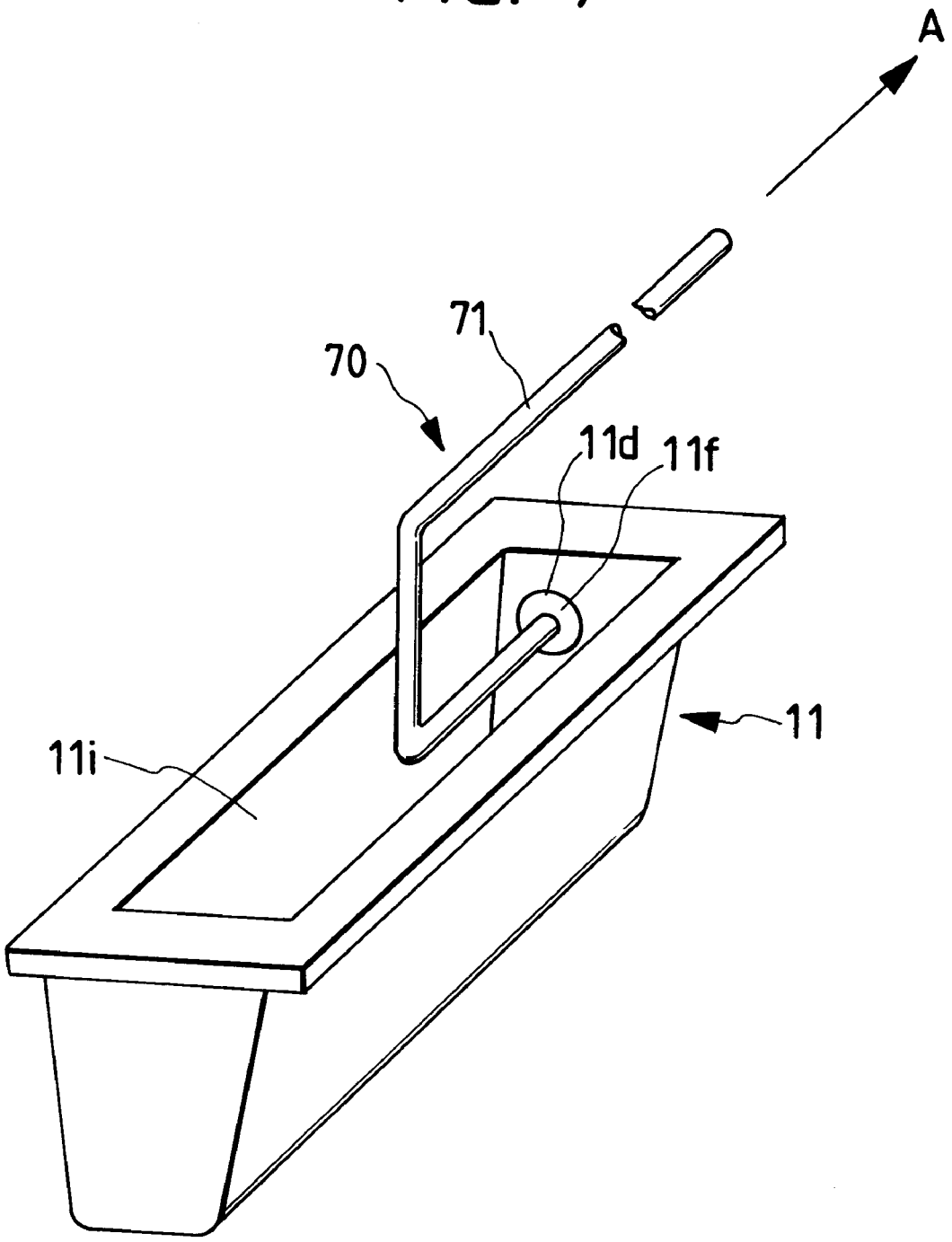
FIG. 7 is a view for explaining a method for removing a cap, according to a first embodied mode of the present invention.

In the first embodied mode, the cap 11*f* is removed from the toner loading opening 11*d* by using a cap removing tool (cap removing means) 70 as shown in FIG. 7.

The cap removing tool 70 has a rod-shaped body portion 71, and an urging portion (abutment portion) 72 formed on one end of the body portion 71. When the cap 11*f* is removed, the urging portion 72 is inserted into the toner frame 11 through the opening portion 11*i*. When the body portion 71 is shifted toward a cap removing direction shown by the arrow A, the urging portion 72 urges or pushes the cap 11*f* fitted in the toner loading opening 11*d* of the toner frame 11. Incidentally, the body portion 71 has a hook-shape to facilitate application of a force directing toward a direction opposite to a cap fitting direction (to the body portion).

Next, the cap removing operation using the cap removing tool 70 will be explained.

First of all, the urging portion 72 is inserted into the toner frame 11 through the opening portion 11*i* of the toner frame 11. Then, the body portion 71 is shifted toward the cap removing direction. As a result, as shown in FIG. 8, the urging portion 72 abuts against a bottom 11*f*1 of the cap to apply the urging force to the cap 11*f*, thereby removing the cap 11*f* from the toner frame 11.

By urging the cap 11*f* by using the cap removing tool 70 from the inside of the toner frame 11 in this way, the cap 11*f* can be removed from the toner frame 11 without damage of the toner frame 11 and/or the cap 11*f* such as deformation, crack or whitening, and thus, the toner frame 11 and the cap 11*f* can be re-used.

Figure 8:
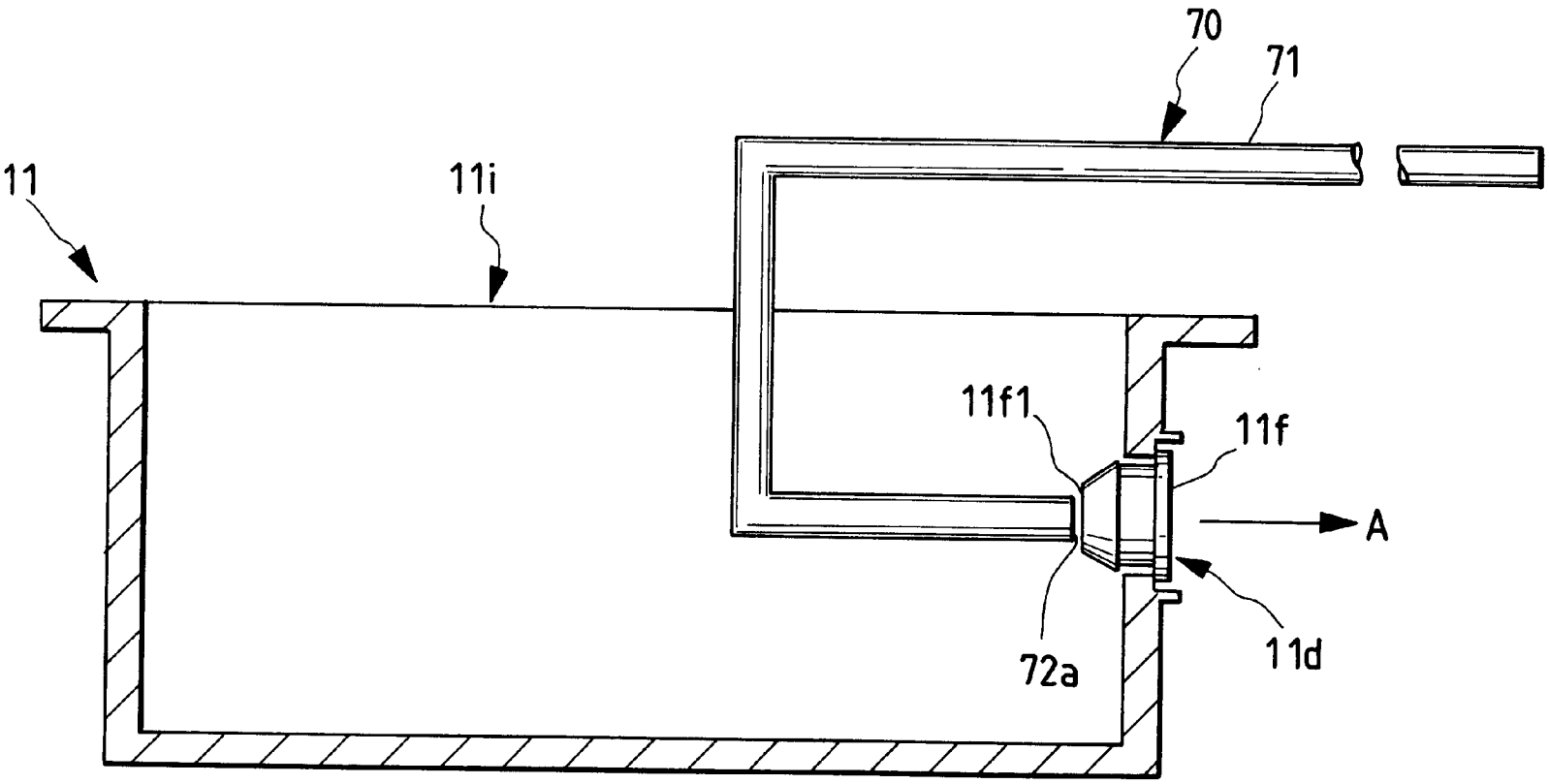
FIG. 8 is a view showing a condition that the cap is removed by a cap removing tool according to the first embodied mode.
Figure 29:
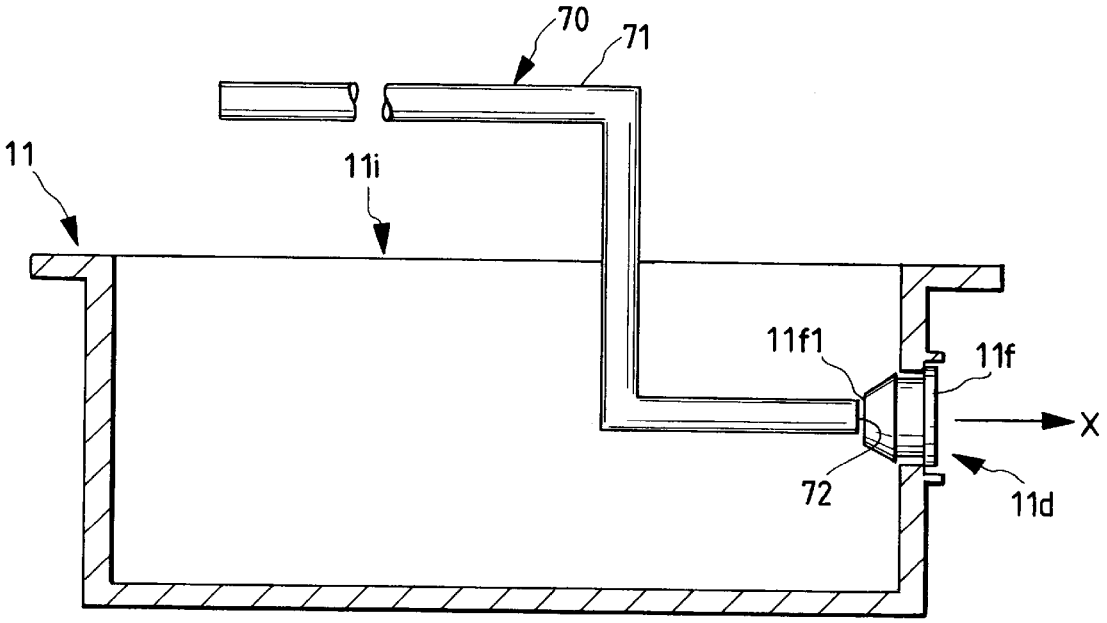
FIGS. 29, 30 and 31 are views for explaining other examples of the cap removing tool according to the first embodied mode.
Figure 30:
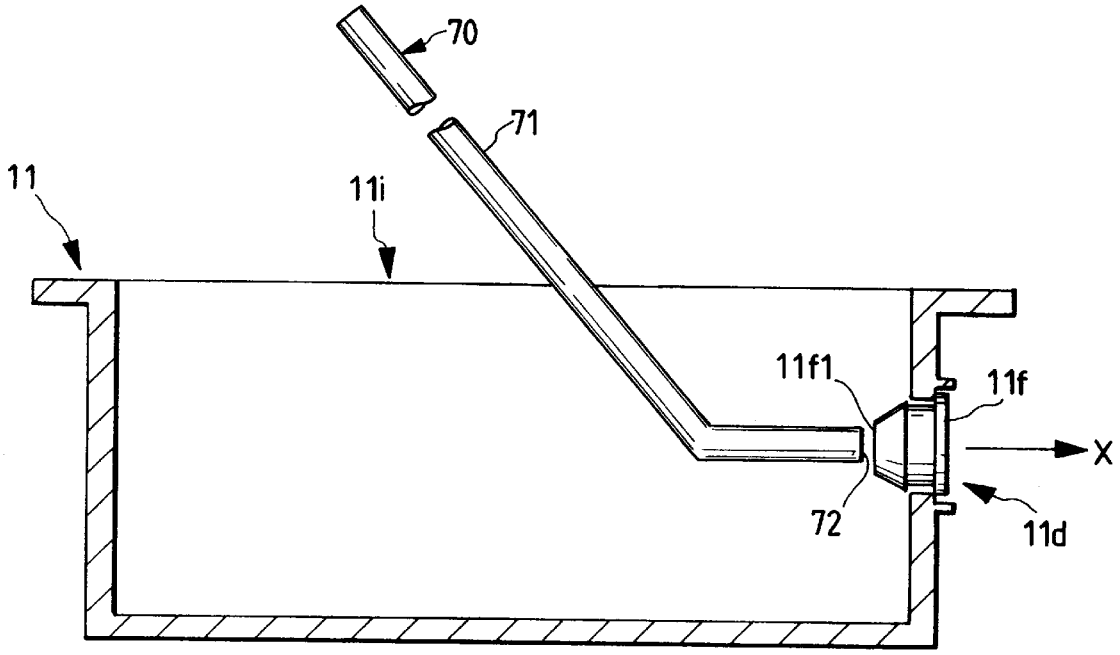
Figure 31:
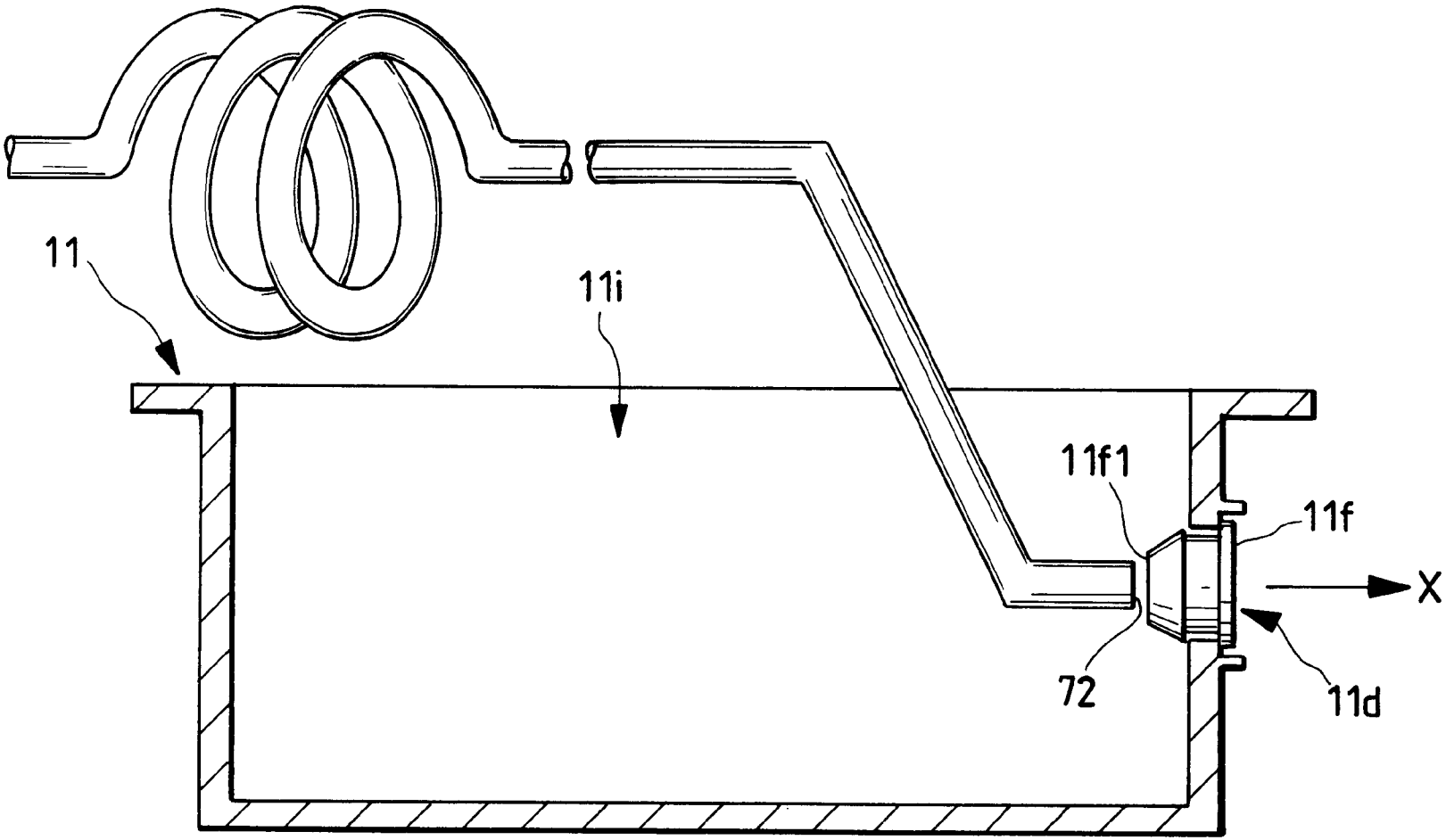

So long as the cap removing tool 70 can be inserted through the opening portion 11*i* and can apply the force directing toward the direction opposite to the cap fitting direction to the cap, the shape of the cap removing tool is not limited to the shape shown in FIG. 8. For example, shapes shown in FIGS. 29 to 31 may be used.

Material of the toner frame 11 and the cap 11*f* may be plastic resin such as polystyrene, shock resistance polystyrene (HIPS), polypropylene, polyethylene, polyethylene terephthalate (PET), ABS or the like.

In a first embodiment of the illustrated embodied mode, the cap 11*f* is made of polyethylene and has an outer diameter of 34 mm, and the developing agent container made of shock resistance polystyrene (HIPS) is used as the toner frame 11, and the cap 11*f* is fitted to the toner frame 11. From test results, it was found that drawing strength of the cap 11*f* is 98.1N.

The drawing strength of the cap was measured as follows. First of all, the cap removing tool 70 was attached to a tension/compression test machine and the cap 11*f* fitted in the loading opening 11*d* was pushed at a speed of 100 mm/min from a direction opposite to the cap fitting direction. And, maximum load measured in this way was defined as the drawing strength of the cap. In this measurement, a portion including the loading opening was cut away from the toner frame 11, and the cap removing tool 70 was urged against the cap from a direction perpendicular to the cap.

Fifty caps 11*f* fitted in corresponding toner frames 11 were prepared, and these caps were removed from the corresponding toner frames by using the cap removing tool 70 with a force of 118N. It was found that there are no deformation, no crack and no whitening in the caps 11*f* and the toner frames 11.

Although the cap 11*f* can be performed manually by using the cap removing tool 70, it is preferable that a device having the cap removing tool 70 is used because the cap can be removed accurately and efficiently by using the device having the cap removing tool 70 (in the above test, the device having the cap removing tool 70 was used).

Next, a second embodiment of the first embodied mode will be explained.

In the second embodiment, the diameter of the cap 11*f* is lightly decreased to obtain the cap drawing strength of 15N, and the cap removing force is selected to 20N. Regarding the other constructions, the toner frame 11 and the cap 11*f* are made of material same as that in the first embodiment. Fifty caps 11*f* fitted in corresponding toner frames 11 were prepared, and the cap removing tests were effected. It was found that there are no deformation, no crack and no whitening in the caps 11*f* and the toner frames 11.

Next, a third embodiment of the first embodied mode will be explained.

In the third embodiment, the diameter of the cap 11*f* is lightly increased to obtain the cap drawing strength of 540N, and the cap removing force is selected to 590N. Regarding the other constructions, the toner frame 11 and the cap 11*f* are made of material same as that in the first embodiment. Fifty caps 11*f* fitted in corresponding toner frames 11 were prepared, and the cap removing tests were effected. It was found that there are no deformation, no crack and no whitening in the caps 11*f* and the toner frames 11.

Next, a fourth embodiment of the first embodied mode will be explained.

Figure 9:
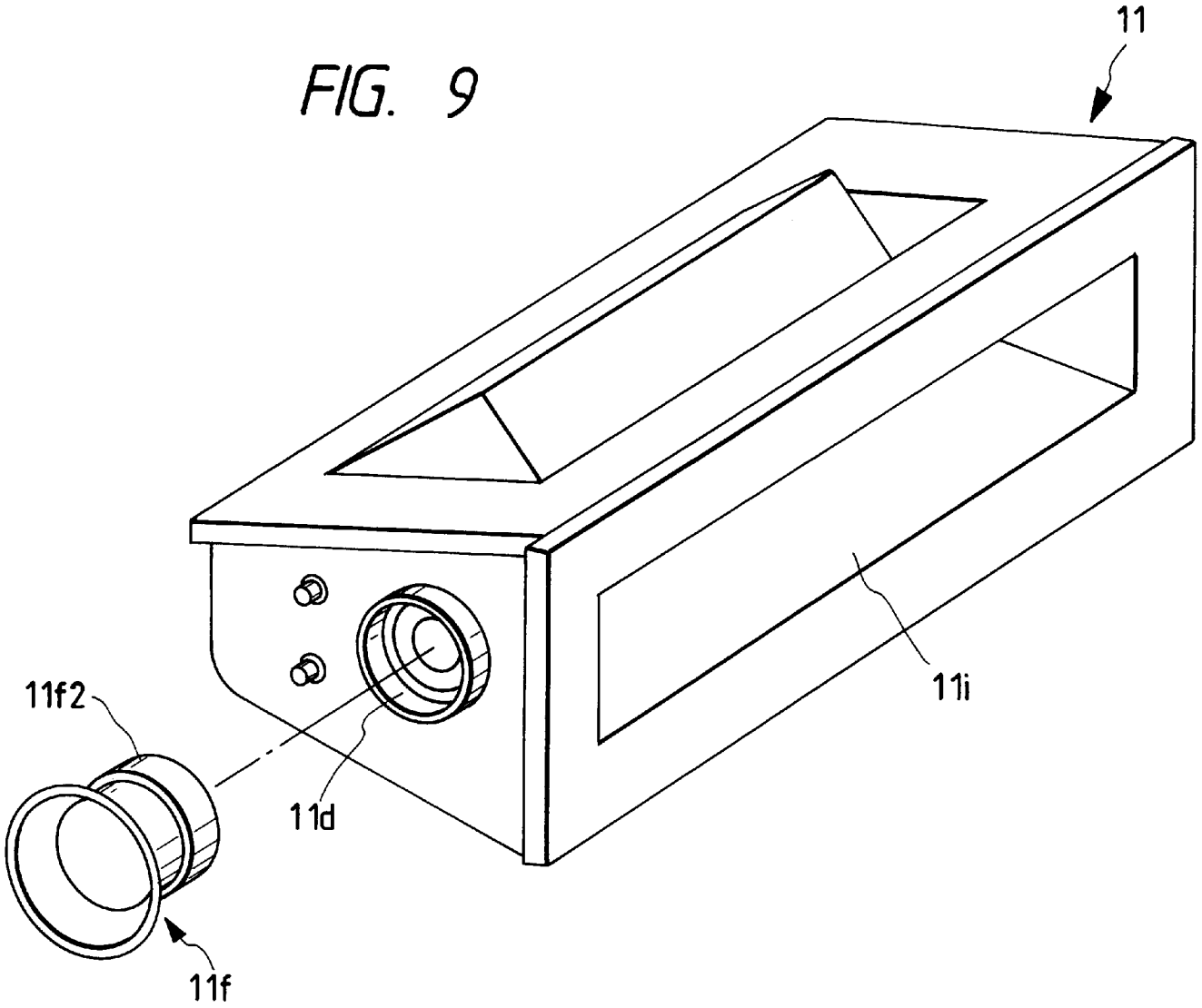
FIG. 9 is a perspective view of a cap and a toner frame according to a fourth embodiment of the embodied mode.
Figure 10A:
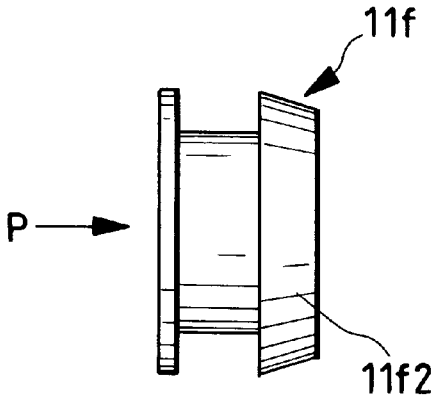
FIG. 10A is a side view of the cap.
Figure 10B:
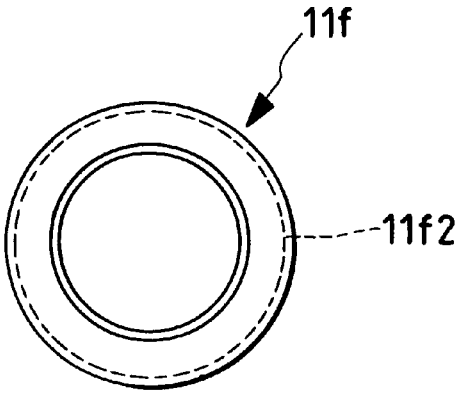
FIG. 10B is a view of the cap looked at from a direction shown by the arrow P in FIG. 10A.
Figure 11A:
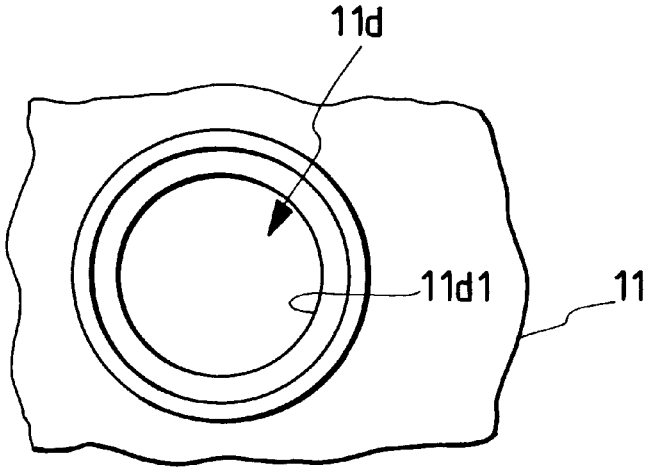
FIG. 11A is a plan view of a loading opening of the toner frame.
Figure 11B:
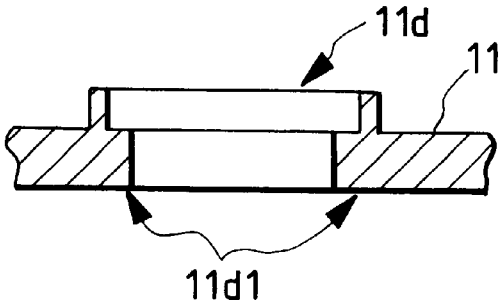
FIG. 11B is a sectional view of the loading opening.

In the fourth embodiment, in order to prevent accidental removal of the cap 11*f* and toner leakage during the transportation, as shown in FIGS. 9 and 10A, 10B, a burr portion 11*f*2 is formed on a tip end of the cap 11*f*. Further, as shown in FIGS. 11A and 11B, the toner loading opening 11*d* is provided at its inner periphery with a locking portion 11*d*1 for locking the burr portion 11*f*2 of the cap 11*f*. In this case, as mentioned above, if the cap is merely removed by the external force, since the burr portion 11*f*2 is locked to the locking portion 11*d*1, the toner loading opening 11*d* and the cap 11*f* will be damaged (deformation and whitening).

Figure 12A:
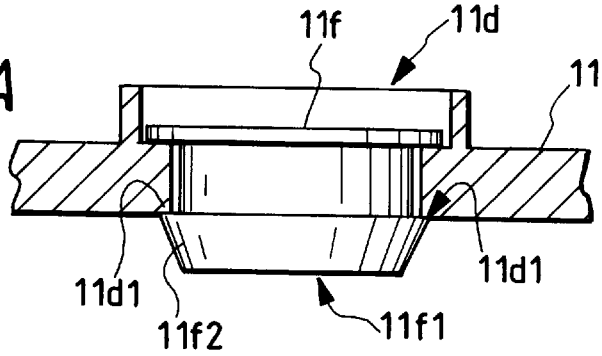
FIGS. 12A, 12B, 12C and 12D are views for explaining a method for removing a cap, according to the fourth embodiment.

Thus, in the fourth embodiment, first of all, as is in the first embodiment, the urging portion 72 is inserted into the toner frame 11 through the opening portion 11*i* to abut the urging portion against the bottom 11*f*1 of the cap 11*f* fitted in the toner loading opening 11*d* with the burr portion 11*f*2 locked to the locking portion 11*d*1, as shown in FIG. 12A.

Figure 12B:
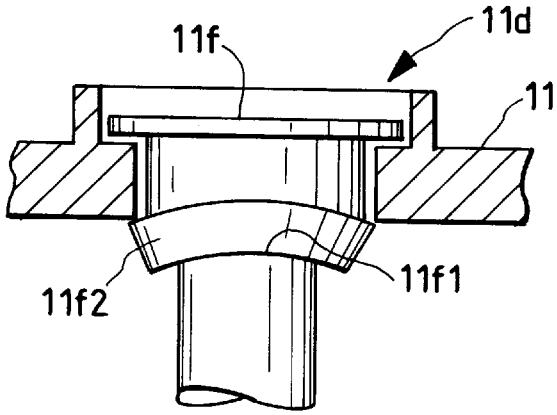
Figure 12C:
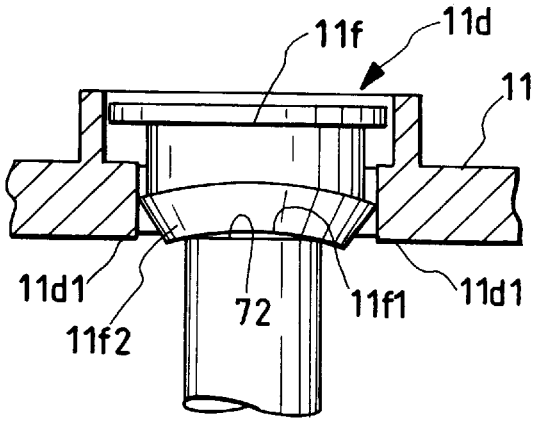
Figure 12D:
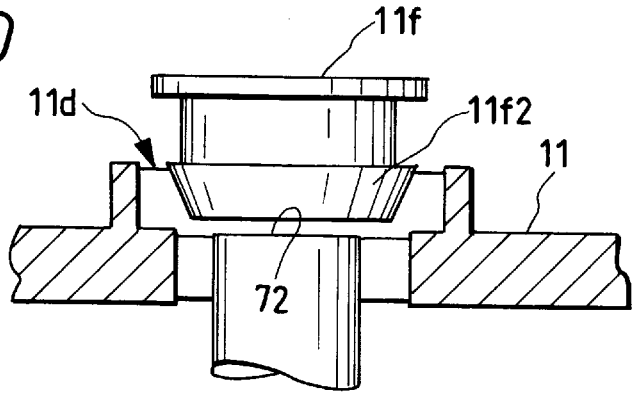

Then, the force is applied to the bottom 11*f*1 of the cap 11*f* by the urging portion 72 from the inside of the toner frame 11 to flex the bottom 11*f*1 of the cap 11*f* as shown in FIG. 12B, thereby reducing the drawing resistance between the toner loading opening 11*d* and the burr portion 11*f*2. In a condition that the burr portion 11*f*2 is flexed or deformed, as shown in FIG. 12C, a further force is applied to shift the cap 11 in the cap removing direction, thereby removing the cap 11*f* from the toner loading opening 11*d*, as shown in FIG. 12D.

By reducing the drawing resistance between the toner loading opening 11*d* and the burr portion 11*f*2 of the cap 11*f* in this way, the removing force for removing the cap 11*f* from the toner frame 11 can be reduced. As a result, the cap 11*f* can be removed from the toner frame 11 without generating the deformation, whitening and damage in the cap 11*f* and the toner frame 11.

In the fourth embodiment, the toner frame 11 is made of material same as that in the first embodiment, and the cap 11*f* is also made of material same as that in the first embodiment and has an outer diameter of 34 mm. The cap drawing strength is selected to 107.8N and the cap removing force is selected to 127.5N. Fifty caps 11*f* fitted in corresponding toner frames 11 were prepared, and the cap removing tests were effected. It was found that there are no deformation, no crack and no whitening in the caps 11*f* and the toner frames 11.

Next, a fifth embodiment of the first embodied mode will be explained.

Figure 13:
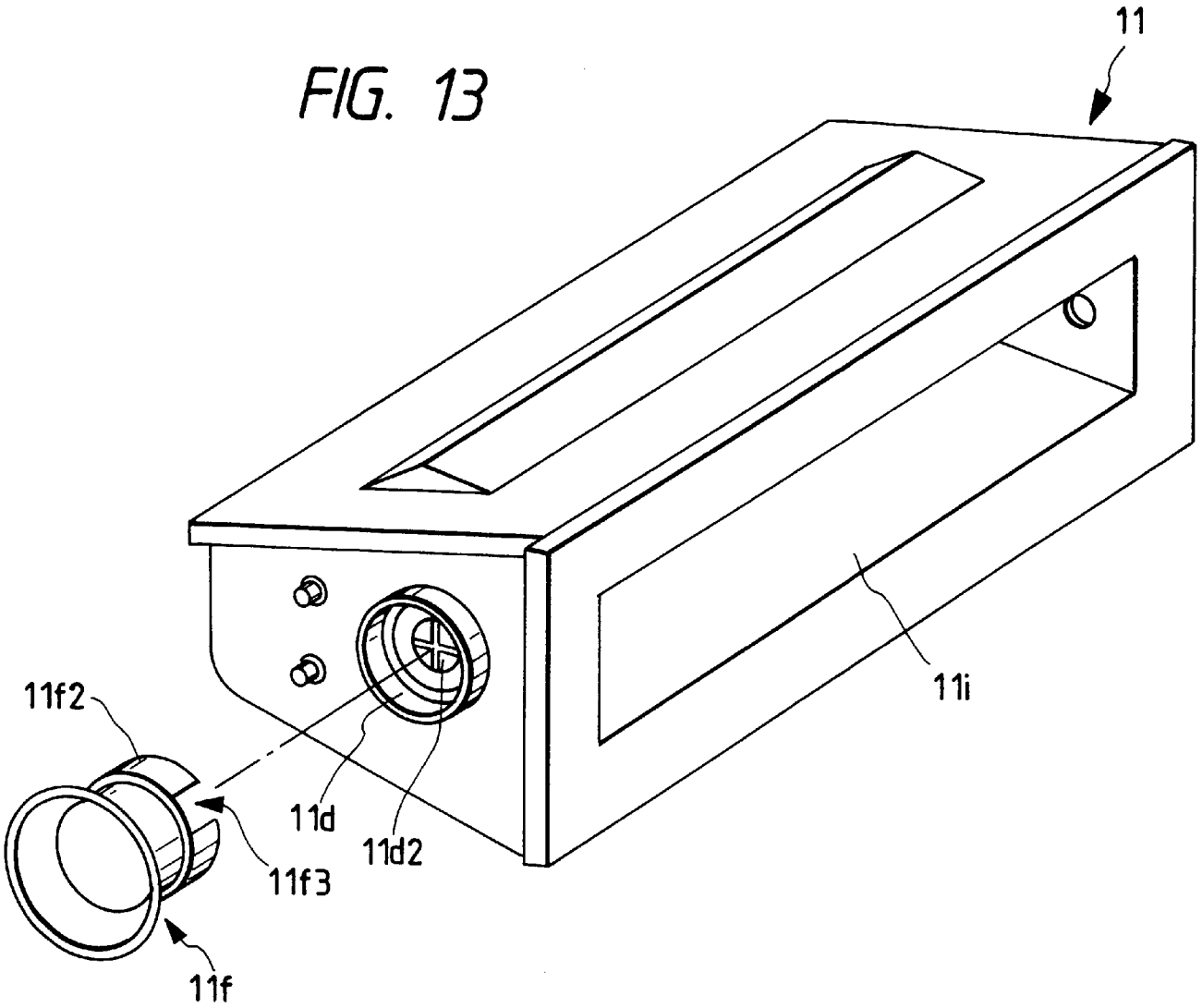
FIG. 13 is a perspective view of a cap and a toner frame according to a fifth embodiment of the embodied mode.
Figure 14A:
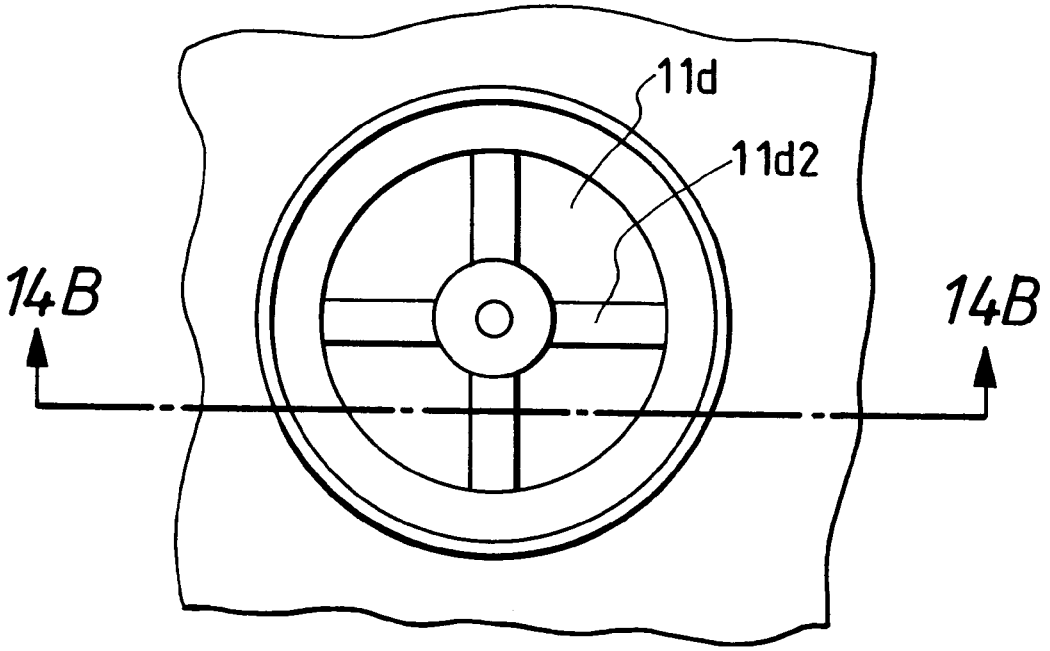
FIG. 14A is a plan view of a loading opening of the toner frame.
Figure 14B:
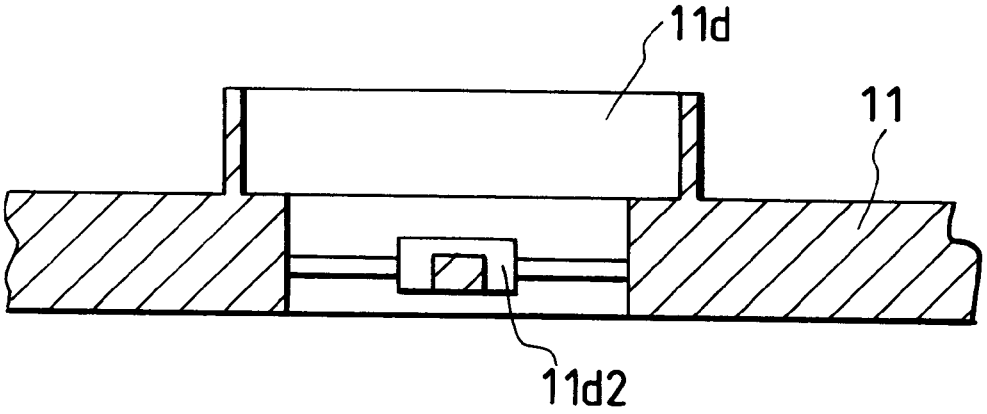
FIG. 14B is a sectional view taken along the line 14B—14B in FIG. 14A.
Figure 15A:
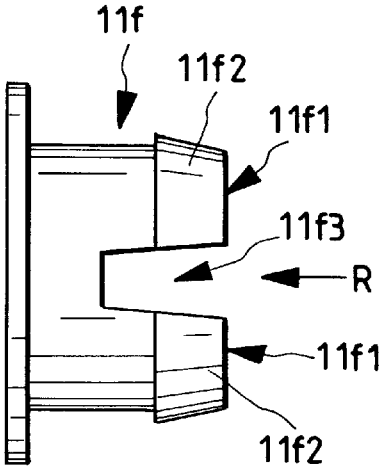
FIG. 15A is a side view of the cap.
Figure 15B:
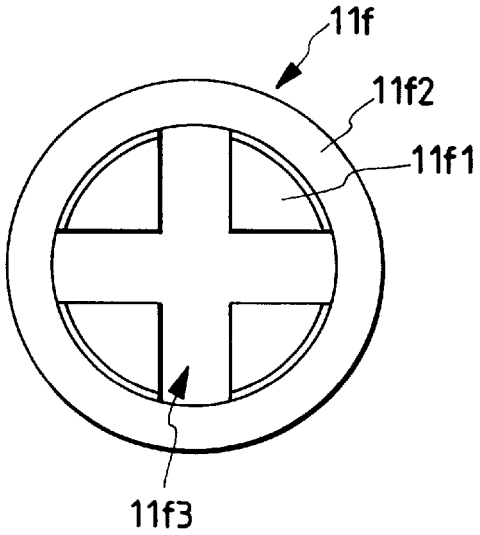
FIG. 15B is a view of the cap looked at from a direction shown by the arrow R in FIG. 15A.
Figure 16:
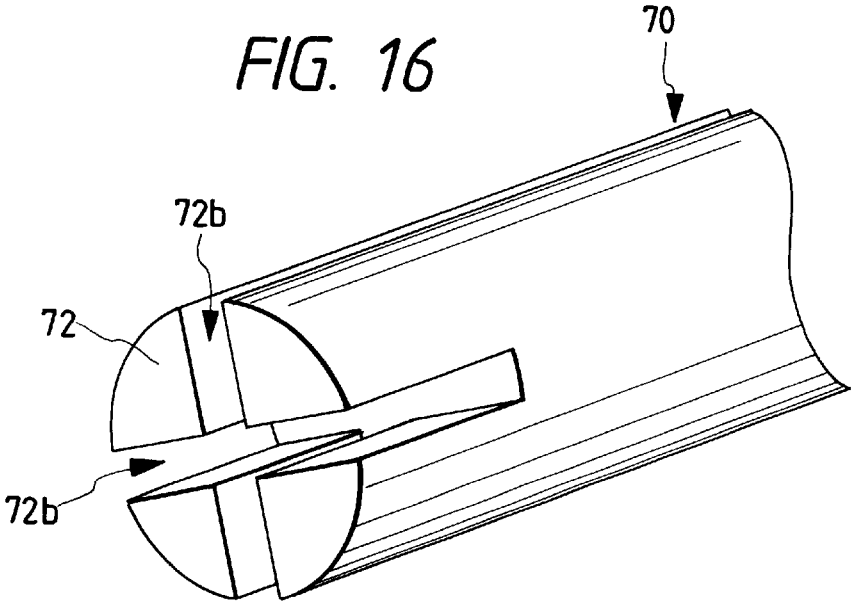
FIG. 16 is a perspective view showing a top end of a cap removing tool for removing the cap.

In the fifth embodiment, as shown in FIGS. 13 and 14A, 14B, the toner loading opening 11*d* is provided with a criss-cross rib 11*d*2 to which an agitating mechanism is attached. Further, as shown in FIGS. 13 and 15A, 15B, the cap 11*f* is provided at its end with a criss-cross groove 11*f*3 for receiving the criss-cross rib 11*d*2. In order to urge the cap 11*f* having such a criss-cross groove 11*f*3 positively, as shown in FIG. 16, the urging portion 72 is provided with a criss-cross groove 72*b* corresponding to the criss-cross rib 11*d*2 of the toner loading opening 11*d*.

Figure 17A:
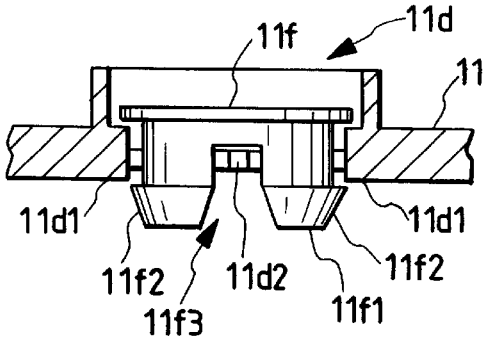
FIGS. 17A, 17B, 17C and 17D are views for explaining a method for removing a cap, according to the fifth embodiment.

Now, a method for removing the cap 11*f* by using such a cap removing tool 70 will be described. First of all, as is in the first embodiment, after the urging portion 72 is inserted into the toner frame 11 through the opening portion 11*i* of the toner frame 11, as shown in FIG. 17A, the urging portion 72 is urged against the bottom 11*f*1 of the cap 11*f* fitted in the toner loading opening 11*d* (with the criss-cross groove 11*f*3 receiving the criss-cross rib 11*d*2 of the toner loading opening 11*d*) while overlapping the criss-cross groove 72*b* with the criss-cross rib 11*d*2.

Figure 17B:
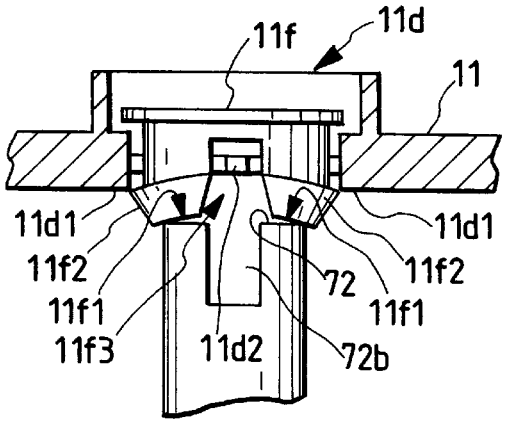
Figure 17C:
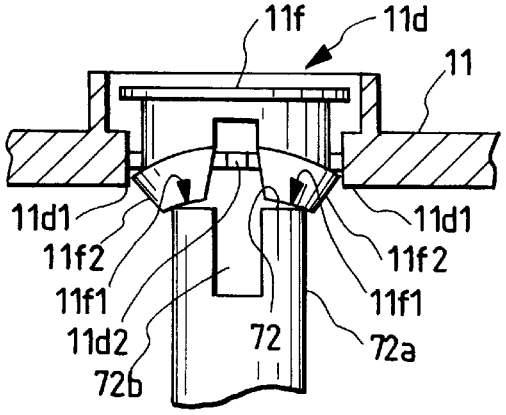
Figure 17D:
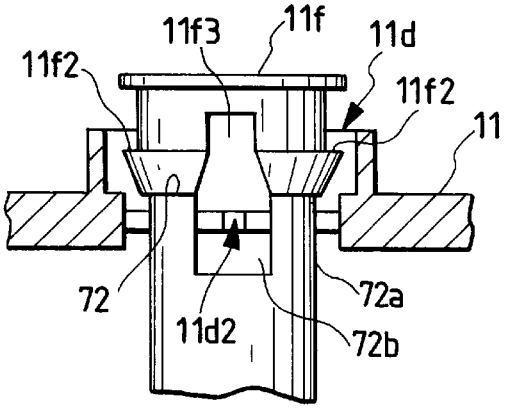

Then, the force is applied to the bottom 11*f*1 of the cap 11*f* by the urging portion 72 from the inside of the toner frame 11 to flex the bottom 11*f*1 of the cap 11*f* as shown in FIG. 17B, thereby reducing the drawing resistance between the toner loading opening 11*d* and the burr portion 11*f*2. In a condition that the burr portion 11*f*2 of the cap 11*f* is flexed or deformed, as shown in FIG. 17C, a further force is applied to shift the cap 11 in the cap removing direction, thereby removing the cap 11*f* from the toner loading opening 11*d*, as shown in FIG. 17D.

In this case, the criss-cross groove 72*b* of the urging portion 72 does not interfere with the criss-cross rib 11*d*2 of the toner loading opening 11*d*. Incidentally, so long as the urging portion 72 can remove the cap 11*f* while deforming the bottom 11*f*1 of the cap without interfering with the criss-cross rib 11*d*2, the shape of the urging portion is not limited to the shape shown in FIG. 16.

In the fifth embodiment, the toner frame 11 is made of material same as that in the first embodiment, and the cap 11*f* is also made of material same as that in the first embodiment and has an outer diameter of 34 mm. The cap drawing strength is selected to 103.0N and the cap removing force is selected to 117.7N. Fifty caps 11*f* fitted in corresponding toner frames 11 were prepared, and the cap removing tests were effected. It was found that there are no deformation, no crack and no whitening in the caps 11*f* and the toner frames 11.

Next, a second embodied mode of the present invention in which, when the cap is removed, a difference is created between the inner diameter of the loading opening and the outer diameter of the cap by cooling the cap will be explained.

Figure 18:
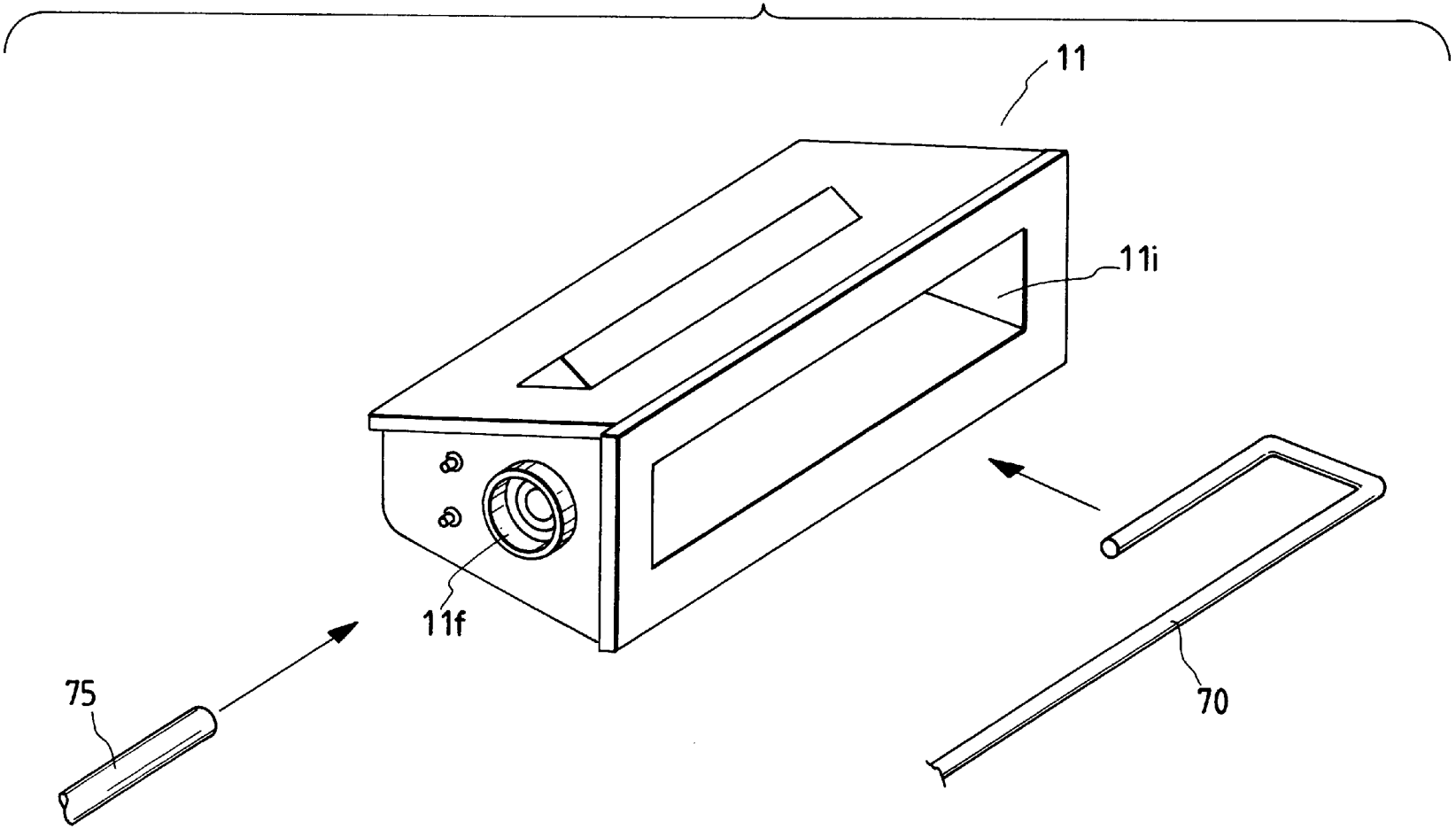
FIG. 18 is a view for explaining a method for removing a cap, according to a second embodied mode of the present invention.

FIG. 18 is a view for explaining a method for removing the cap according to the second embodied mode. In FIG. 18, by cooling the cap 11*f* by a cooling means 75, the cap 11*f* is contracted to create a difference between the outer diameter of the cap 11*f* and the inner diameter of the toner loading opening 11*d*, thereby reducing the drawing resistance between the cap 11*f* and the toner loading opening 11*d*.

Now, the operation for removing the cap according to this embodied mode will be described.

Figure 19A:
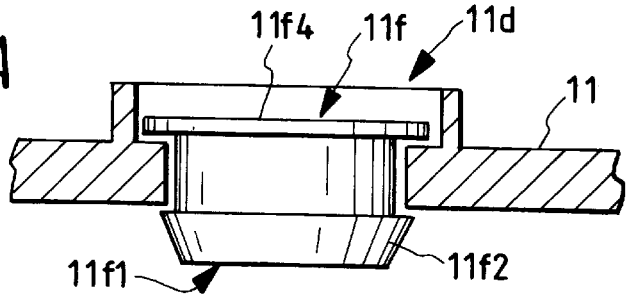
FIGS. 19A, 19B, 19C and 19D are views showing conditions that the cap is removed by a cap removing tool according to the second embodied mode and a cooling means.
Figure 19B:
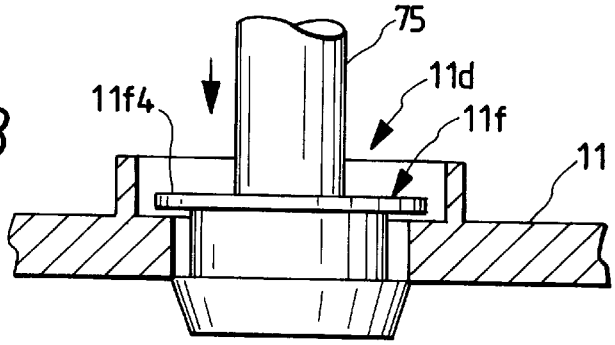

First of all, as is in the first embodied mode, the urging portion 72 is inserted into the toner frame 11 through the opening portion 11*i*. Then, as shown in FIG. 19B, the cooling means 75 is positioned in the vicinity of a head 11*f*4 (FIG. 19A) of the cap 11*f*, thereby cooling the cap 11*f*. Consequently, the cap 11*f* is contracted to create the difference between the outer diameter of the cap 11*f* and the inner diameter of the toner loading opening 11*d* of the toner frame 11, so that the drawing resistance between the cap 11*f* and the toner loading opening 11*d* of the toner frame 11 can be reduced.

Figure 19C:
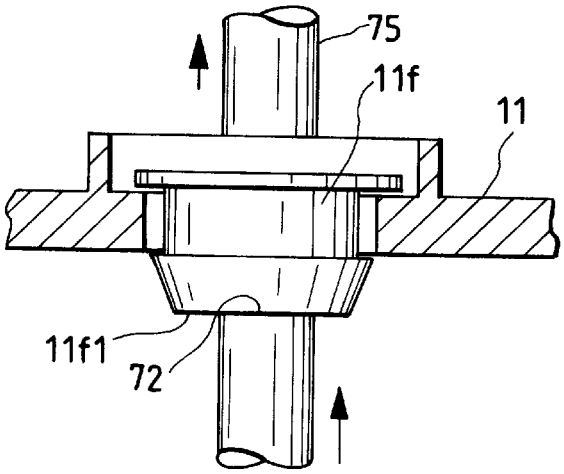
Figure 19D:
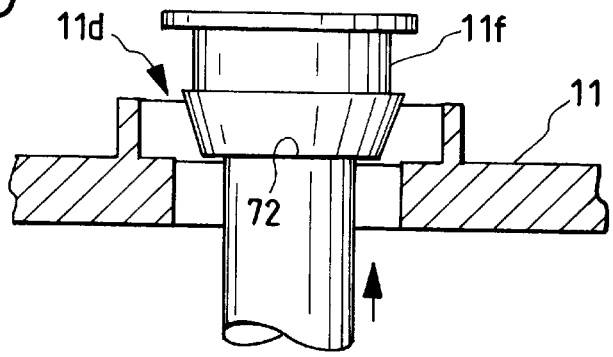

In this condition, as shown in FIG. 19C, the tip end of the urging member 72 is urged against the bottom 11*f*1 of the cap and the cooling means 75 is retarded and the force is applied to the bottom 11*f*1 of the cap 11*f*, or, the force is applied to the bottom 11*f*1 of the cap 11*f* from the inside of the toner frame 11 while retarding the cooling means 75, thereby shifting the cap 11*f* in the cap removing direction. In this way, the cap 11*f* is removed from the toner loading opening 11*d* as shown in FIG. 19D.

By creating the difference between the outer diameter of the cap 11*f* and the inner diameter of the toner loading opening 11*d* of the toner frame 11 by cooling the cap 11*f*. In this way, the drawing resistance between the toner loading opening 11*d* and the cap 11*f* can be reduced. As a result, since the cap removing force for removing the cap 11*f* from the toner frame 11 is decreased, the cap can be removed from the toner frame 11 without generating the deformation, whitening and damage in the cap 11*f* and the toner frame 11.

So long as the difference between the outer diameter of the cap 11*f* and the inner diameter of the toner loading opening 11*d* sufficient to reduce the drawing resistance therebetween can be attained, the urging portion 72 may be inserted after the cap 11*f* was cooled.

Figure 20A:
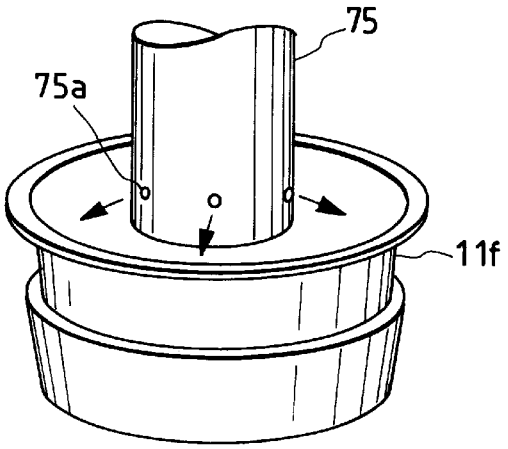
FIG. 20A is a perspective view showing an example of a tip end of the cooling means.
Figure 21A:
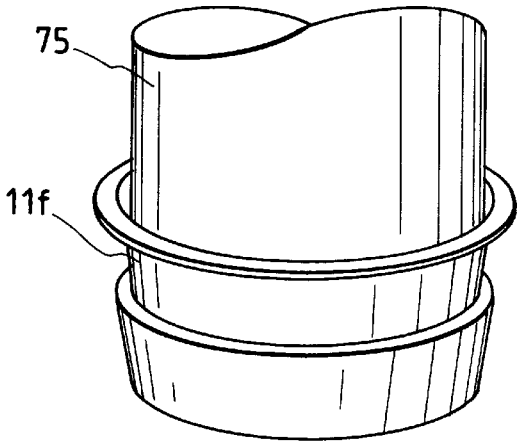
FIG. 21A is a perspective view showing another example of a tip end of the cooling means.
Figure 20B:
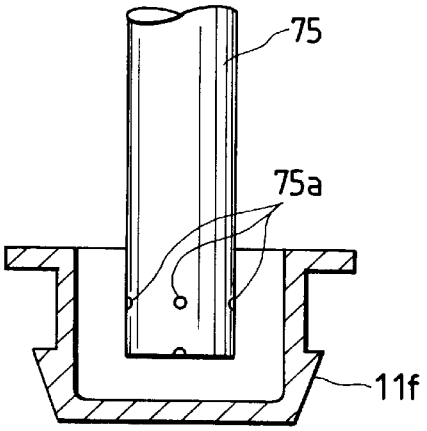
FIG. 20B is a sectional view of the tip end of the cooling means.
Figure 21B:
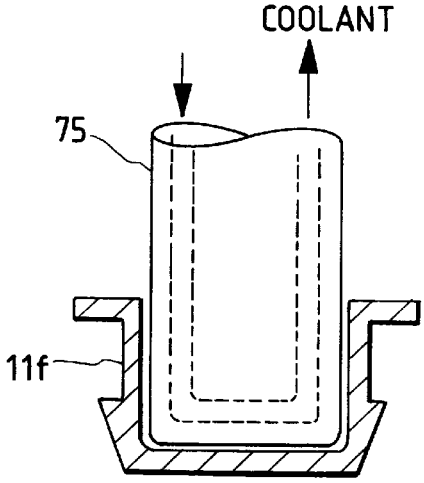
FIG. 21B is a sectional view of the tip end of the cooling means.

Further, as the cooling means 75, for example, as shown in FIGS. 20A and 20B, a cooling means 75 having injection holes 75*a* may be used so that cooling air is injected from the injection holes 75*a* as shown by the arrows to cool the cap 11*f*. Alternatively, as shown in FIGS. 21A and 21B, coolant may be circulated through the cooling means 75 to cool the cap 11*f*.

The cap drawing strength before cooling is selected to 101N and the cap removing force after cooling is selected to 83.4N. Fifty caps 11*f* fitted in corresponding toner frames 11 were prepared, and the cap removing tests were effected. It was found that there are no deformation, no crack and no whitening in the caps 11*f* and the toner frames 11.

Next, a third embodied mode of the present invention in which, when the cap is removed, a difference is created between the inner diameter of the loading opening and the outer diameter of the cap by heating the loading opening will be explained.

Figure 22:
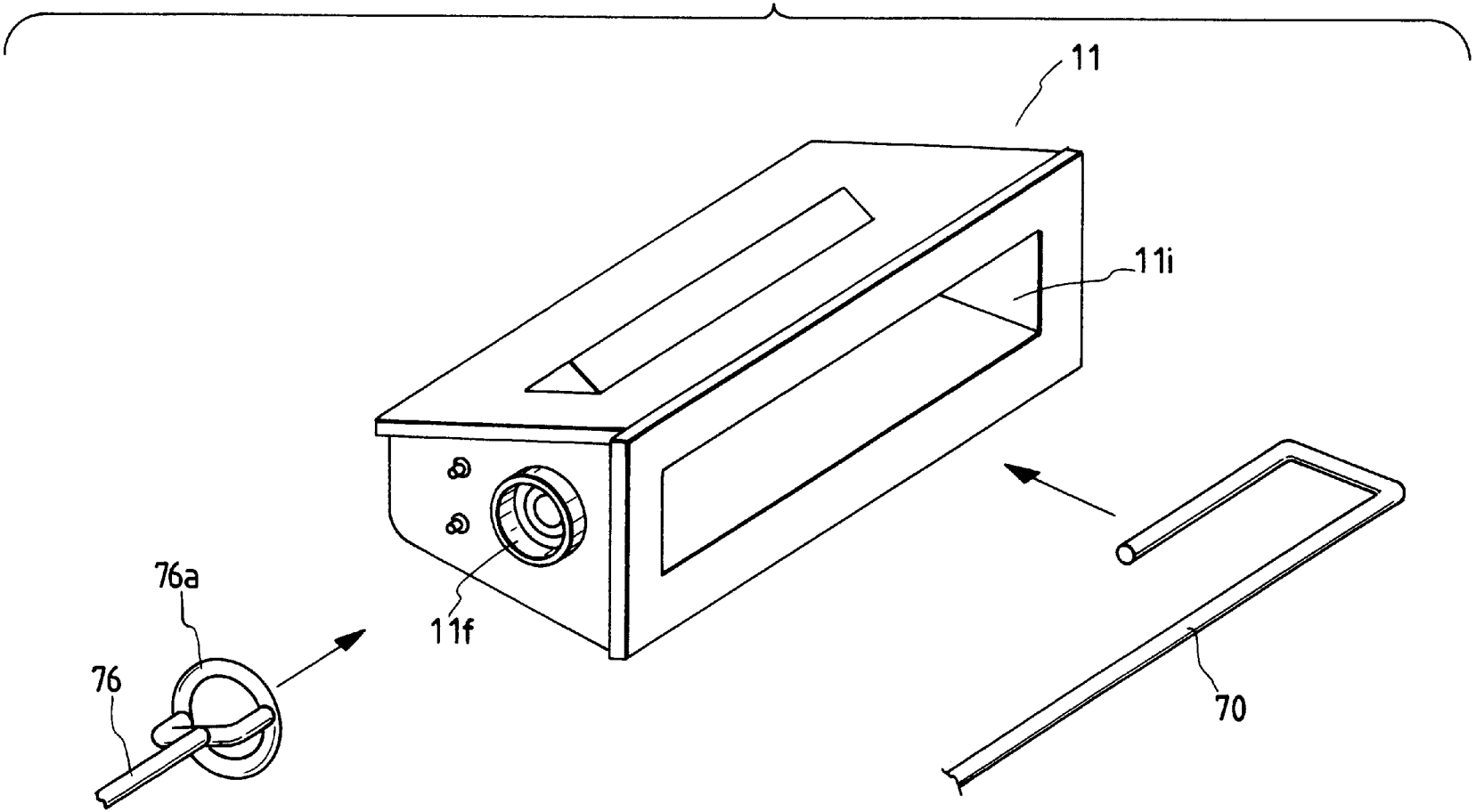
FIG. 22 is a view for explaining a method for removing a cap, according to a third embodied mode of the present invention.

In FIG. 22 for explaining a method for removing the cap according to the third embodied mode, a heating member 76 is provided at its tip end with a heating means 76*a* for heating the toner loading opening 11*d*. By heating the toner loading opening 11*d* by the heating means 76*a*, the toner loading opening 11*d* is expanded to create a difference between the outer diameter of the cap 11*f* and the inner diameter of the toner loading opening 11*d*, thereby reducing the drawing resistance between the cap 11*f* and the toner loading opening 11*d*.

Now, the operation for removing the cap according to this embodied mode will be described.

Figure 23A:
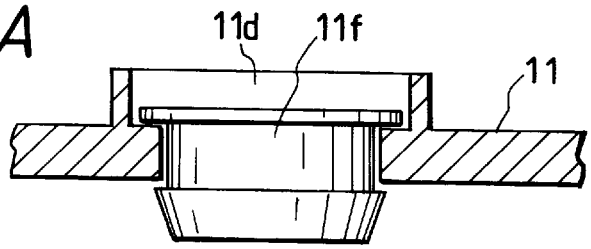
FIGS. 23A, 23B and 23C are views showing conditions that the cap is removed by a cap removing tool according to the second embodied mode and a heating means.
Figure 24:
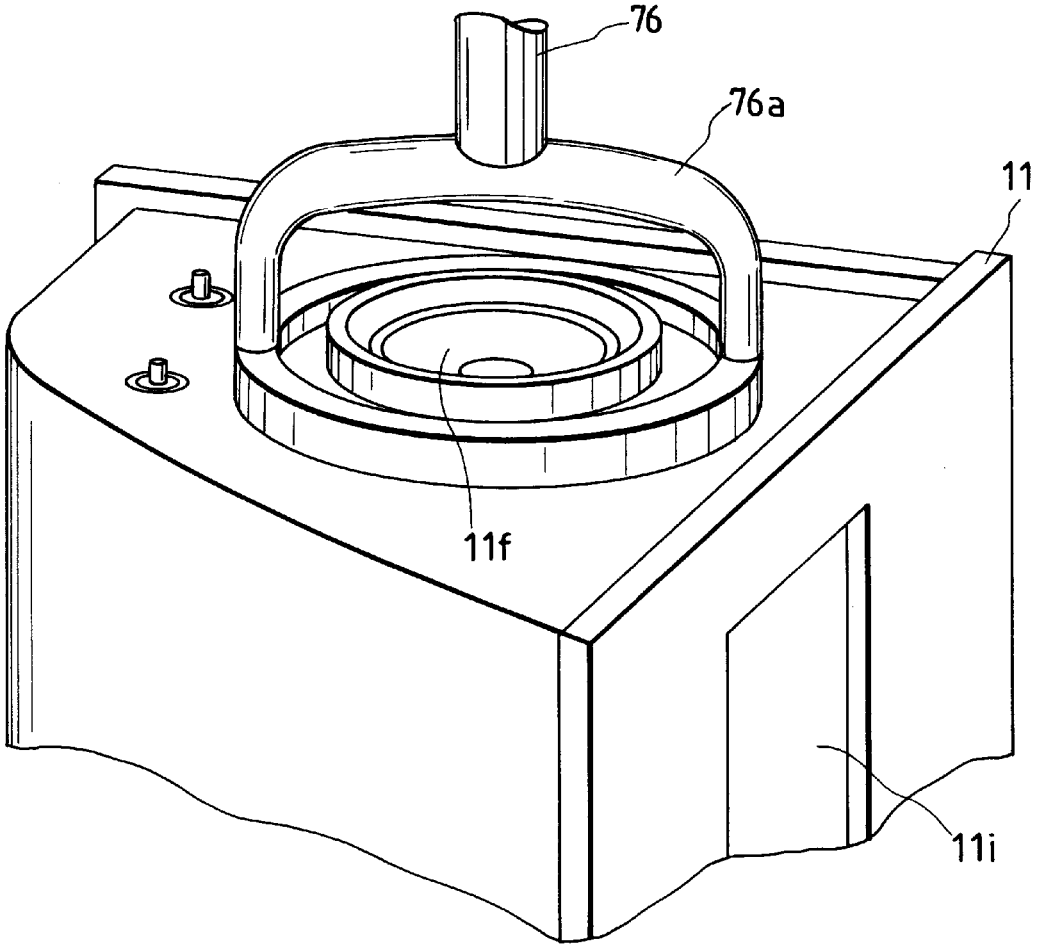
FIG. 24 is a perspective view showing a condition that the heating member is fitted on the cap.

First of all, as is in the first embodied mode, the urging portion 72 is inserted into the toner frame 11 through the opening portion 11*i*. Then, as shown in FIG. 24, the heating means 76*a* is positioned in the vicinity of the toner loading opening into which the cap 11*f* was fitted as shown in FIG. 23A, thereby heating the toner loading opening 11d. Consequently, the toner loading opening 11*d* is expanded to create the difference between the outer diameter of the cap 11*f* and the inner diameter of the toner loading opening 11*d*, so that the drawing resistance between the cap 11*f* and the toner loading opening 11*d* is reduced.

Figure 23B:
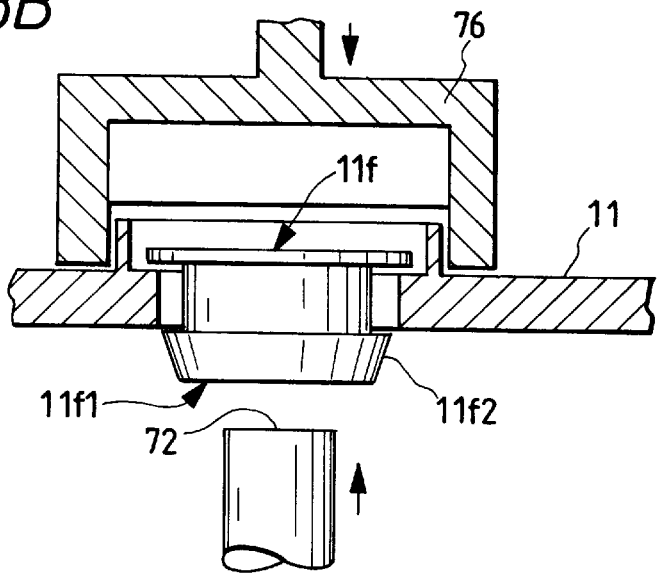
Figure 23C:
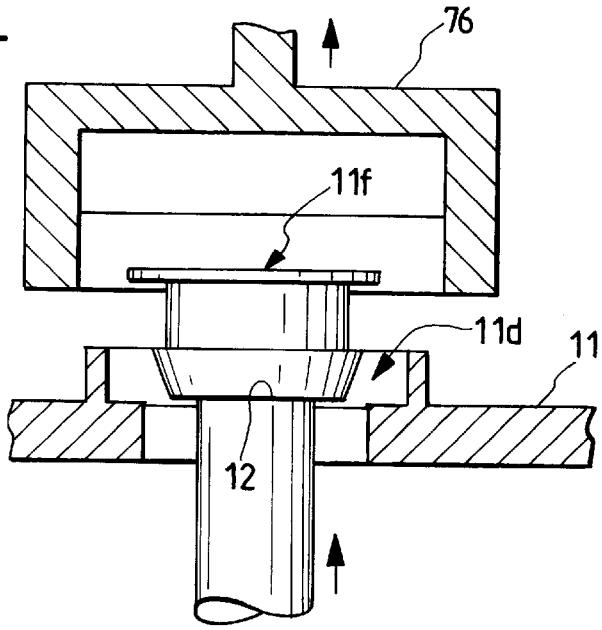

In this condition, as shown in FIG. 23B, the urging member 72 is urged against the bottom 11*f*1 of the cap and the heating means 76*a* is retarded and the force is applied to the bottom 11*f*1 of the cap 11*f*, or, the force is applied to the bottom 11*f*1 of the cap 11*f* from the inside of the toner frame 11 while retarding the heating means 76*a*, thereby shifting the cap 11 in the cap removing direction. In this way, the cap 11*f* is removed from the toner loading opening 11*d* as shown in FIG. 23C.

By creating the difference between the outer diameter of the cap 11*f* and the inner diameter of the toner loading opening 11*d* of the toner frame 11 by heating the toner loading opening 11*d* in this way, the drawing resistance between the toner loading opening 11*d* and the cap 11*f* can be reduced. As a result, since the cap removing force for removing the cap 11*f* from the toner frame 11 is decreased, the cap can be removed from the toner frame 11 without generating the deformation, whitening and damage in the cap 11*f* and the toner frame 11.

So long as the difference between the outer diameter of the cap 11*f* and the inner diameter of the toner loading opening 11*d* sufficient to reduce the drawing resistance between the cap 11*f* and the toner loading opening 11*d* of the toner frame 11 can be attained, the urging portion 72 may be inserted after the toner loading opening 11*d* was heated.

Figure 25A:
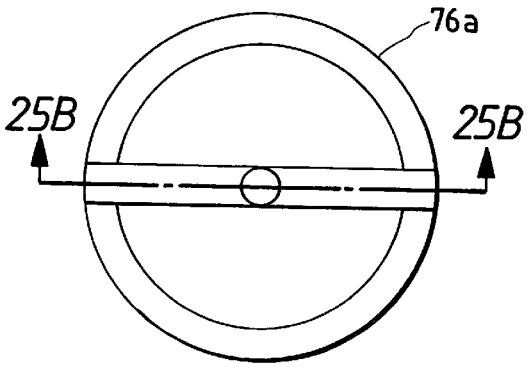
FIG. 25A is a plan view showing an example of a tip end of the heating means.
Figure 25B:
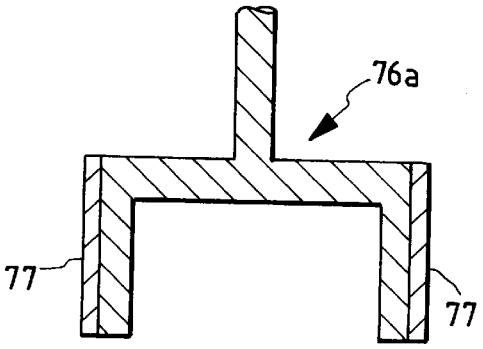
FIG. 25B is a sectional view taken along the line 25B—25B in FIG. 25A.
Figure 25C:
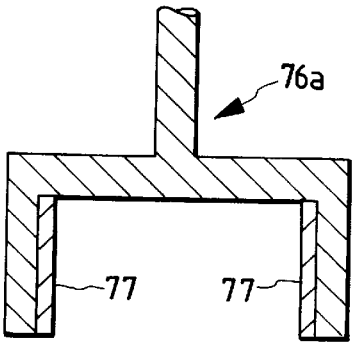
FIG. 25C is a sectional view showing an alteration of FIG. 25A.
Figure 26A:
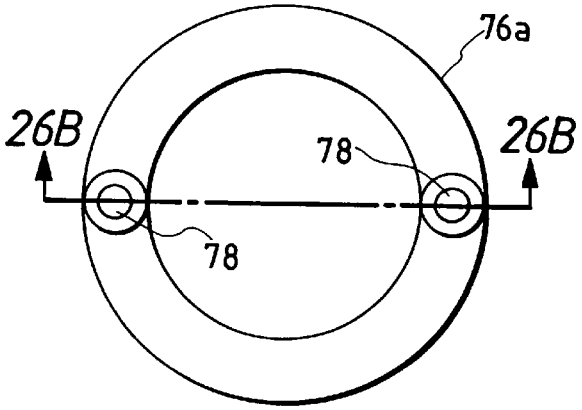
FIG. 26A is a plan view showing another example of a tip end of the heating means.
Figure 26B:
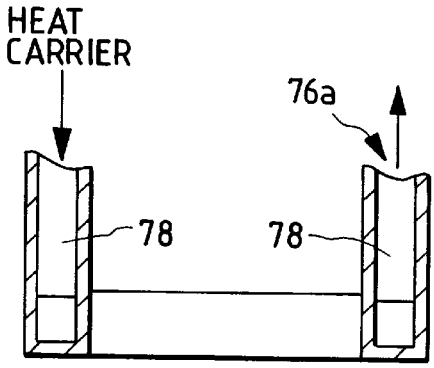
FIG. 26B is a sectional view taken along the line 26B—26B in FIG. 26A.
Figure 26C:
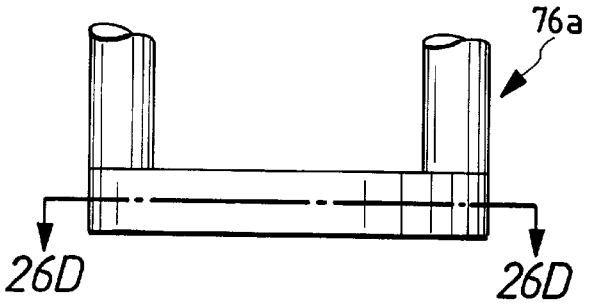
FIG. 26C is a side view.
Figure 26D:
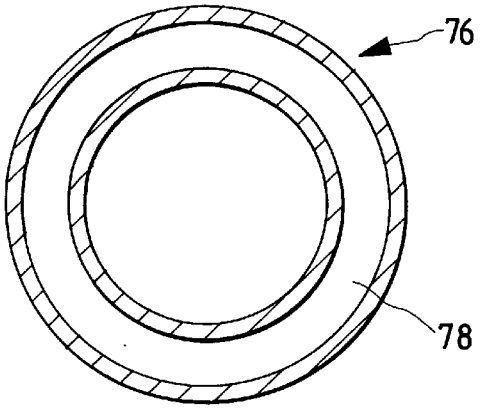
FIG. 26D is a sectional view taken along the line 26D—26D in FIG. 26C.
Figure 27A:
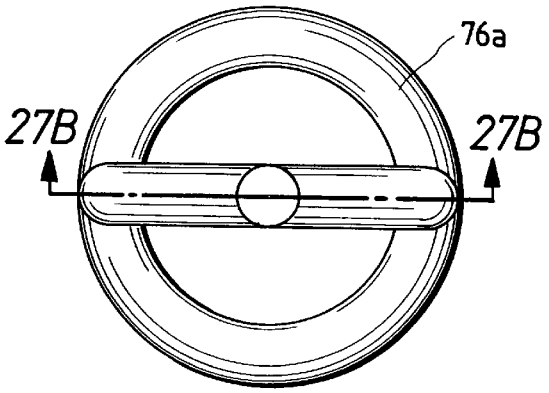
FIG. 27A is a plan view showing a further example of a tip end of the heating means.
Figure 27C:
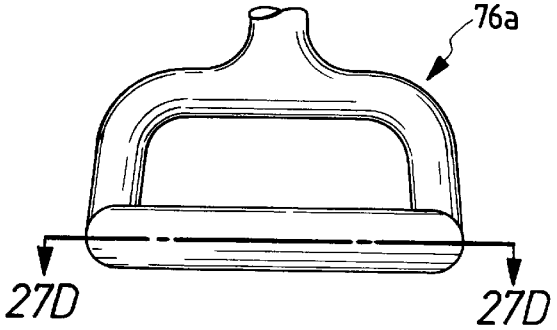
FIG. 27C is a side view.
Figure 27B:
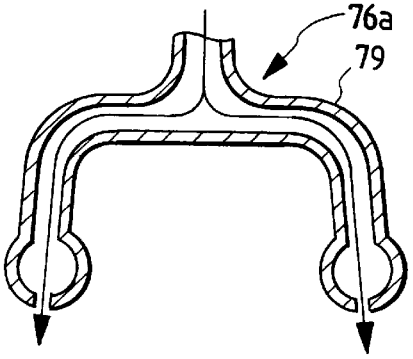
FIG. 27B is a sectional view taken along the line 27B—27B in FIG. 27A.
Figure 27D:
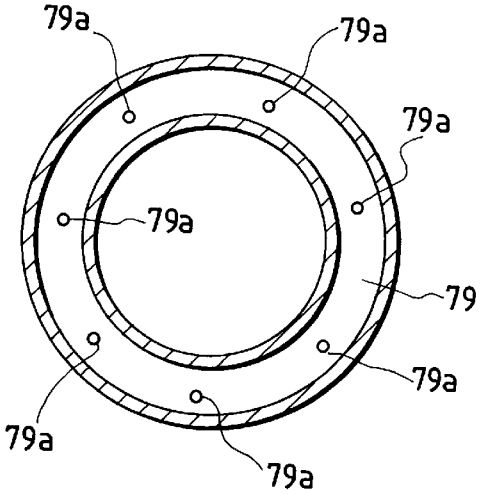
FIG. 27D is a sectional view taken along the line 27D—27D in FIG. 27C.

As shown in FIGS. 25A to 25C, the heating means 76*a* may have a heater 77 provided on an outer or inner surface of the heating means 76*a* to heat the toner loading opening 11*d*. Alternatively, as shown in FIGS. 26A to 26D, the heating means 76*a* may have conduit or conduits 78 through which heat carrier can flow to heat the toner loading opening 11*d*. Alternatively, as shown in FIGS. 27A to 27D, the heating means 76*a* may have a conduit 79 having a plurality of injection holes 79*a* from which heating gas is injected to heat the toner loading opening 11*d*.

As an embodiment of the third embodied mode, the toner frame 11 is made of material same as that in the above-mentioned first embodiment of the first embodied mode, and the cap 11*f* is also made of material same as that in the first embodiment and has an outer diameter of 34 mm. Further, the heating means 76*a* as shown in FIGS. 25A and 25B is used.

The cap drawing strength before heating is selected to 99.5N and the cap removing force after heating is selected to 88.6N. Fifty caps 11*f* fitted in corresponding toner frames 11 were prepared, and the cap removing tests were effected. It was found that there are no deformation, no crack and no whitening in the caps 11*f* and the toner frames 11.

Next, a comparison example will be described.

Figure 28:
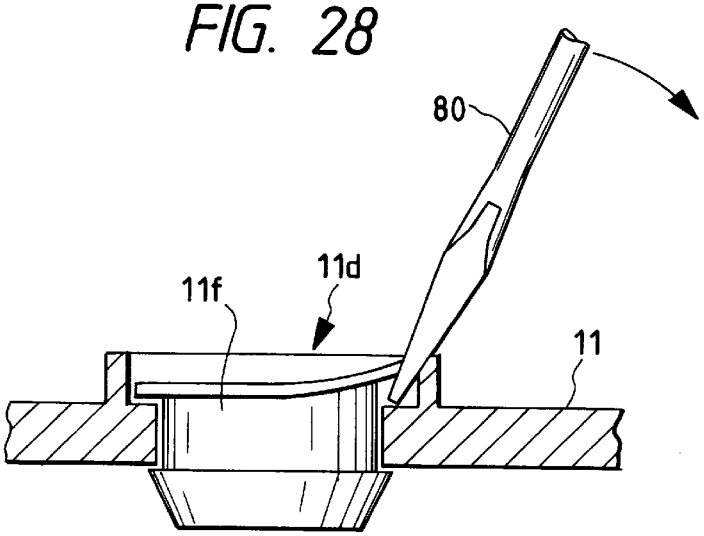
FIG. 28 is a view for explaining a method for removing a cap, according to a comparison example.

In this comparison example, the same toner frame 11 and cap 11*f* as that in the first embodiment are used. As shown in FIG. 28, after the cap 11*f* fitted in the toner loading opening was removed from the toner frame 11 from the outside of the toner frame by using a tool 80 such as a driver, it was found that the whitening and crack are generated in the cap 11*f* and the loading opening of the toner frame 11.

To the contrary, in the present invention, after the urging portion 72 of the cap removing tool 70 is inserted into the interior of the toner frame 11 through the opening portion 11*i*, since the body portion 71 is shifted in the cap removing direction to push the cap 11*f* fitted in the toner loading opening 11*d* from the inside to thereby remove the cap 11*f*, the whitening and crack can be prevented from generating in the cap 11*f* and the loading opening of the toner frame 11.

Incidentally, in the above descriptions, while an example that the circular cap 11*f* (and toner loading opening 11*d*) are used was explained, the present invention is not limited to such an example, but, a triangular cap used in order to increase an effective area of the toner loading opening may be used. Thus, the cap is not limited to the particular shape.

As mentioned above, according to the present invention, there can be provided a seal member removing tool and a seal member removing method, in which a seal member closing a developing agent loading opening of a developing agent container can surely be removed from the developing agent container.

Further, according to the present invention, there can be provided a seal member removing tool and a seal member removing method, in which a seal member closing a developing agent loading opening of a developing agent container can surely be removed from the developing agent container, without damaging the developing agent container and the seal member.

What is claimed is:

1. A seal member removing tool for removing a seal member fitted in a developing agent loading opening of a developing agent container, comprising:

(a) a bent body portion; and (b) an abutment portion provided on one end of said body portion to be abutted against said seal member from inside of said container to remove said seal member from said container.

2. A seal member removing tool according to claim 1, wherein said body portion extends toward a predetermined direction and is bent on a way to direct a tip end of said body portion substantially toward a direction opposite to said predetermined direction, and said abutment portion is provided on said tip end.

3. A seal member removing tool according to claim 1, wherein said body portion extends from its one end toward a predetermined direction and is bent on a way to direct the other end of said body portion substantially toward a direction opposite to said predetermined direction, and said abutment portion is provided on said the other end.

4. A seal member removing tool according to claim 1, wherein said container is provided with a pass opening through which the developing agent contained in said container can be supplied to a developing member for developing a latent image formed on a photosensitive member, and the seal member removing tool is inserted into said container through said pass opening so that said abutment portion is abutted against said seal member from the inside of said container to remove said seal member from said container.

5. A seal member removing method for removing a seal member fitted in a developing agent loading opening of a developing agent container, comprising the steps of:

(a) preparing a removing tool including a bent body portion, and an abutment portion provided on one end of said body portion to be abutted against said seal member from inside of said container to remove said seal member from said container; and (b) removing said seal member from said container by abutting said abutment portion against said seal member from inside of said container.

6. A seal member removing method according to claim 5, wherein said body portion extends toward a predetermined direction and is bent on a way to direct a tip end of said body portion substantially toward a direction opposite to said predetermined direction, and said abutment portion is provided on said tip end.

7. A seal member removing method according to claim 5, wherein said body portion extends from its one end toward a predetermined direction and is bent on a way to direct the other end of said body portion substantially toward a direction opposite to said predetermined direction, and said abutment portion is provided on said the other end.

8. A seal member removing method according to claim 5, wherein said container is provided with a pass opening through which the developing agent contained in said container can be supplied to a developing member for developing a latent image formed on a photosensitive member, and the seal member removing tool is inserted into said container through said pass opening so that said abutment portion is abutted against said seal member from the inside of said container to remove said seal member from said container.

9. A seal member removing method according to claim 5, further comprising a step of heating said developing agent loading opening.

10. A seal member removing method according to claim 5, further comprising a step of cooling said seal member.

* * * * *

UNITED STATES PATENT AND TRADEMARK OFFICE

CERTIFICATE OF CORRECTION

PATENT NO. : 5,926,675
DATED : July 20, 1999
INVENTOR(S) : Kazuyuki Miyano, et al.

It is certified that error appears in the above-identified patent and that said Letters Patent is hereby corrected as shown below:

Sheet 7:
Figure 7, insert "72" and related leadline as shown below:

FIG. 7

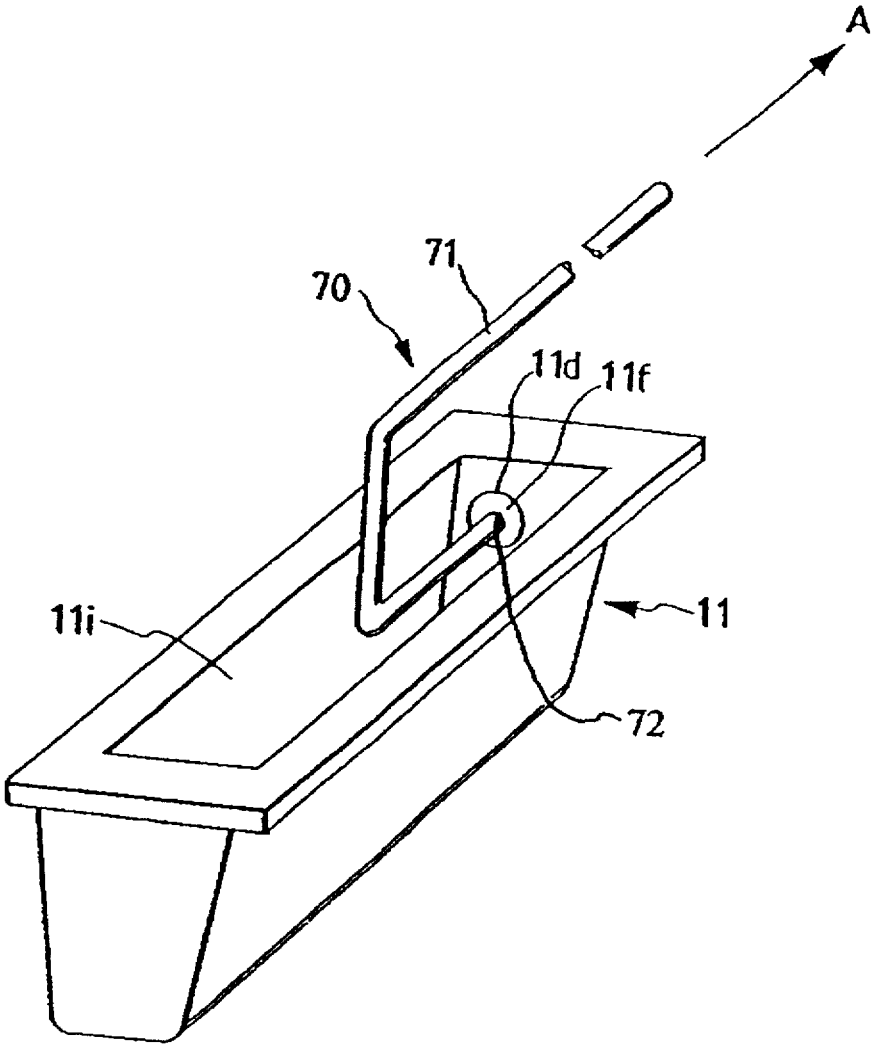

UNITED STATES PATENT AND TRADEMARK OFFICE

CERTIFICATE OF CORRECTION

PATENT NO. : 5,926,675
DATED : July 20, 1999
INVENTOR(S) : Kazuyuki Miyano, et al.

It is certified that error appears in the above-identified patent and that said Letters Patent is hereby corrected as shown below:

SHEET 8:
Figure 8, insert "72a" should read --72--.

SHEET 9:
Figure 9, "11d" should read --lldl--.

COLUMN 1:
Line 15, "as" should read --as the--.
Line 33, "the" (second occurrence) should read --a--.
Line 47, "expert" should read --maintenance expert--.

COLUMN 3:
Line 33, "with" (first occurrence) should be deleted.
Line 34, "reference" should read --with reference--.
Line 66, "tone" should read --toner--.

COLUMN 4:
Line 13, "tone" should read --toner--.

COLUMN 5:
Line 1, "voltage" should read --a voltage--.
Line 31, "matters" should read --matter--.

COLUMN 6:
Line 9, "adhesive" should read --an adhesive--.
Line 10, "snap-fit" should read --a snap-fit--.
Line 14, "to" should read --with--.
Line 34, "directing" should read --directed--.
Line 53, "directing" should read --directed--.

UNITED STATES PATENT AND TRADEMARK OFFICE

CERTIFICATE OF CORRECTION

PATENT NO. : 5,926,675
DATED : July 20, 1999
INVENTOR(S) : Kazuyuki Miyano, et al.

It is certified that error appears in the above-identified patent and that said Letters Patent is hereby corrected as shown below:

COLUMN 7:
Line 14, "are" should read --were--.
Line 15, "crack" should read --cracking--; and "in" should read --of--.
Line 14, "are" should read --were--.
Line 15, "crack" should read --cracking--; and "in" should read --of--.
Line 17, "Although" should read --Although removing--.
Line 29, "material same as that" should read --materials, which are same as that used--.
Line 32, "are" should read --was--; and "crack" should read --cracking--.
Line 40, "material same as that" should read --materials, which are same as that used--.
Line 43, "are should read --was--; and "crack" should read --cracking--.
Line 44, "in" should read --of--.

COLUMN 8:
Line 16, "material same as that" should read --material, which is same as that used--.
Line 21, "are" should read --was--; and "crack" should read --cracking--.
Line 22, "in" should read --of--.
Line 64, "material same as that" should read --material, which is the same as that used--.
Line 65, "material same as that" should read --material, which is same as that used--.

COLUMN 9:
Line 3, "are" should read --was--.
Line 4, "crack" should read --cracking--; and "in" should read --of--.
Line 64, "are" should read --was--; and "crack" should read --cracking--.
Line 65, "in" should read --of--.

COLUMN 10:
Line 43, "in" should read --of--.
Line 50, "was" should read --is--.
Line 62, "material same as that" should read --material, which is the same as that used--.
Line 64, "material same as that" should read --material, which is same as that used--.

UNITED STATES PATENT AND TRADEMARK OFFICE

CERTIFICATE OF CORRECTION

PATENT NO. : 5,926,675
DATED : July 20, 1999
INVENTOR(S) : Kazuyuki Miyano, et al.

It is certified that error appears in the above-identified patent and that said Letters Patent is hereby corrected as shown below:

COLUMN 11:
Line 5, "are" should read --was--; and "crack" should read --cracking--.
Line 6, "in" should read --of--.
Line 20, "the" (second occurrence) should be deleted.
Line 21, "crack" should read --cracking of the--.
Line 28, "the" (second occurrence) should read --a--.
Line 53, "on" should read --in--

COLUMN 12:
Line 2, "its" should read --said--.
Line 3, "on" should read --in--; and "the" should read --an--.
Line 6, "the" should be deleted.
Line 30, "on" should read --in--.
Line 35, "its" should read --said--.
Line 36, "on" should read --in--; and "the" should read --an--.
Line 39, "the" should be deleted.

Signed and Sealed this

Seventh Day of August, 2001

*Attest:*

Nicholas P. Godici

*Attesting Officer*

NICHOLAS P. GODICI
*Acting Director of the United States Patent and Trademark Office*